US006194984B1

(12) United States Patent
Kappel et al.

(10) Patent No.: US 6,194,984 B1
(45) **Date of Patent: *Feb. 27, 2001**

(54) MOVABLE CONTACT ASSEMBLY FOR AN ELECTRICAL CONTACTOR

(75) Inventors: Mark A. Kappel, Brookfield; Richard G. Smith, Caledonia; Donald F. Swietlik, Waukesha; Raymond H. Hannula, Delafield; Christopher J. Wieloch, Brookfield, all of WI (US)

(73) Assignee: Rockwell Technologies, LLC, Thousand Oaks, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,207

(22) Filed: Sep. 30, 1998

(Under 37 CFR 1.47)

(51) Int. Cl.[7] ..... H01H 67/02
(52) U.S. Cl. ..... 335/132; 218/152; 218/155
(58) Field of Search ..... 335/8–10, 132, 335/201, 202; 218/9, 10, 152, 155

(56) References Cited

U.S. PATENT DOCUMENTS

| | | | | |
|---|---|---|---|---|
| 3,437,773 | * | 4/1969 | Koertge | 335/132 |
| 5,635,886 | * | 6/1997 | Pichard | 335/132 |
| 5,717,370 | * | 2/1998 | Haas | 335/132 |
| 5,844,457 | * | 12/1998 | Eckroth et al. | 335/132 |
| 5,959,517 | * | 9/1999 | Wieloch et al. | 335/16 |

* cited by examiner

*Primary Examiner*—Lincoln Donovan
(74) *Attorney, Agent, or Firm*—Patrick S. Yoder; John J. Horn; William R. Walburn

(57) ABSTRACT

A movable contact assembly for contactors and similar devices includes a movable spanner or conductive element biased toward a conducting position by a biasing element. A housing partially surrounds the conductive element and the biasing element. The biasing element and exerts compressive forces against the housing and the conductive element. The assembly may be installed as a modular unit on a carrier which is displaced during operation of the contactor. The housing shields the biasing element from plasma, arcs and debris during operation of the device. Multiple conductive elements and corresponding biasing elements may be includes in each assembly.

19 Claims, 19 Drawing Sheets

FIG. 21
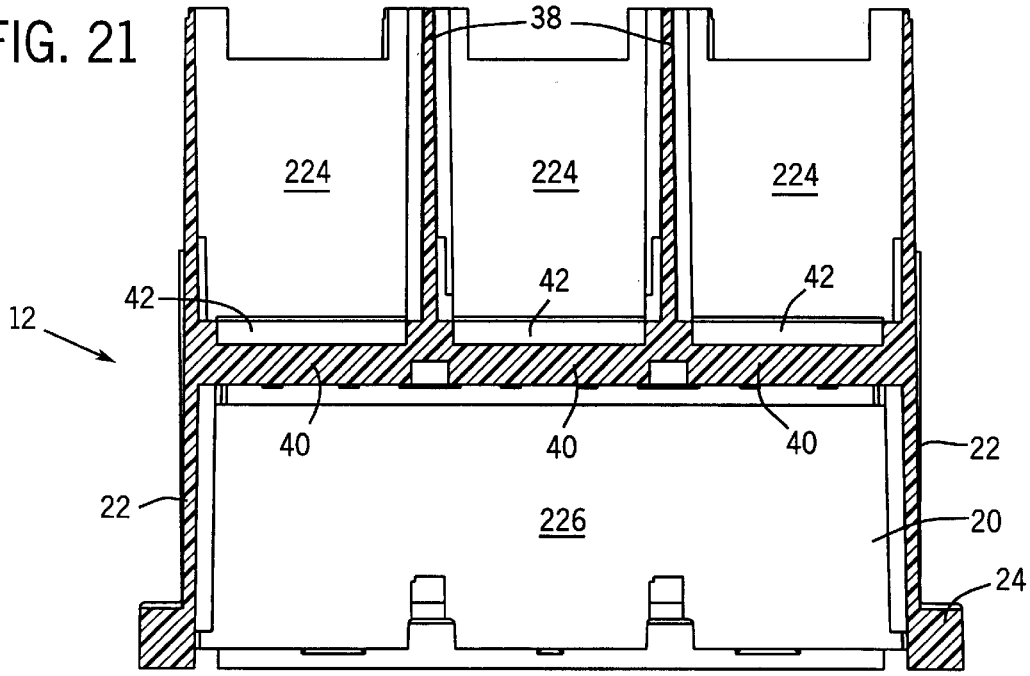
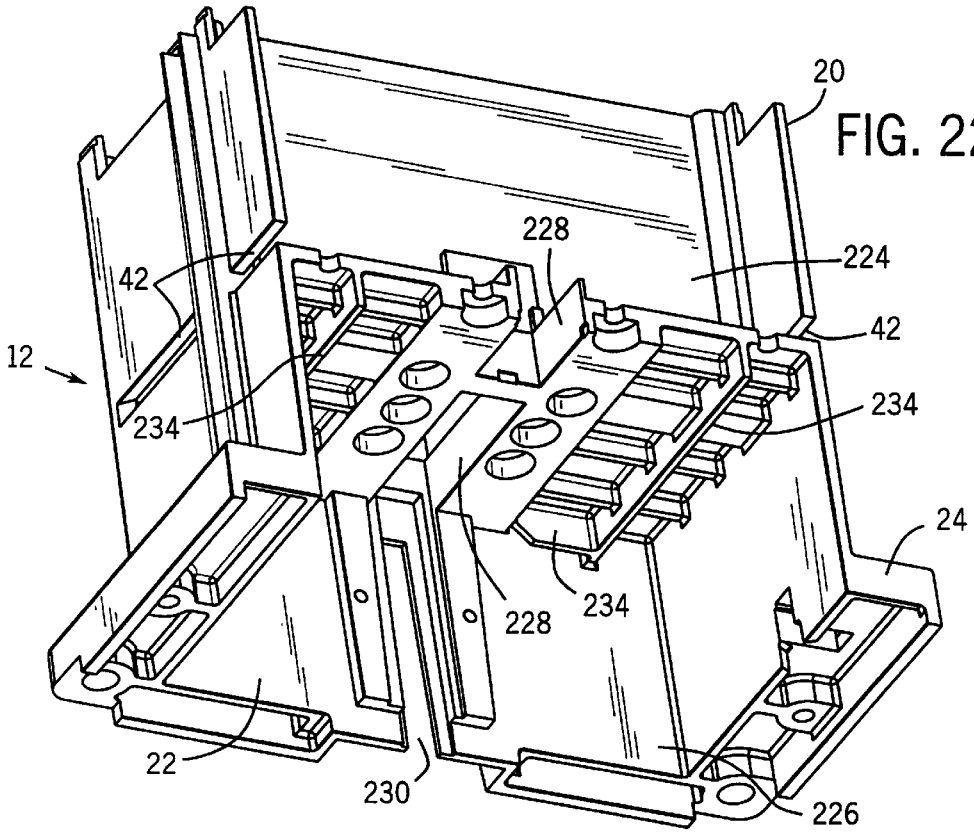
FIG. 22

MOVABLE CONTACT ASSEMBLY FOR AN ELECTRICAL CONTACTOR

BACKGROUND OF THE INVENTION

1. Field of the Invention

The present invention relates to electrical contact devices such as multi-phase contactors. More particularly, the invention relates to a movable contact arrangement for a contactor, in the form of a modular arrangement which provides ease of assembly and replacement, as well as excellent electrical performance and isolation capabilities.

2. Description of the Related Art

A large number of electrical contact devices have been proposed and are currently in use. In one type of device, commonly referred to as a contactor, a movable conductive assembly is provided between a pair of stationary contacts. The movable assembly includes movable contacts which span the stationary contacts when the device is closed. The movable contacts may be actuated by an electromagnetic actuating assembly which, when energized, causes the movable contacts to complete a current carrying path between the stationary contacts, or to open such a path, depending upon whether the device is installed in a normally-open and normally-closed configuration.

Movable contact structures are designed to provide for rapid opening and closing of the electrical path between the stationary contact structures, as well as to endure a number of opening and closing cycles during the useful life of the device. Movable contacts have been designed, therefore, to provide various schemes for making and breaking the electrical path within a contactor to minimize arcing and other phenomena which can damage the structures. In one such arrangement, arc contacts are closed before separate shunt contacts during making of the contactor, and are opened after the shunt contacts upon breaking. In either case, the devices are typically designed so as to promote migration of arcs away from contact pads on the stationary and movable contacts towards splitter plates and similar structures which serve to cool and extinguish the arcs. Moreover, in multi-phase devices, dividers, partitions, or similar arrangements are typically provided between movable and stationary contact sections for each phase, to avoid phase-to-phase short circuits during opening and closing.

Despite improvements in arc handling and isolation in contactors of the type described above, persistent difficulties still exist. For example, in many contactors movable contact structures are provided in a single modular unit, typically including a carrier assembly for linking the movable contacts to an actuating assembly. If, over time, the movable contacts are damaged due to arcing, pitting, and similar phenomena, the entire movable contact assembly must be replaced. Depending upon the size of the contactor, this assembly can be quite large and expensive. Moreover, depending upon the manner in which the movable contact assembly is supported and connected with associated components within the device, extensive dismantling of the contactor may be required for the replacement of the assembly.

In addition to the foregoing drawbacks, movable contact assemblies have often been structured in less than optimal arrangements from a mechanical standpoint. For example, conductive spanning elements in movable contact assemblies are typically resiliently biased toward a contact position in the assembly such that some flexibility of movement will be possible when the movable contact is urged against stationary contacts. This arrangement typically takes the form of a tensioned member surrounding at least a portion of the movable conductive spanner, and springs extending between the spanner and the tension member. The resulting structure requires a number of independent parts to be manufactured and assembled in the stationary contact, adding to the cost and complexity of the structure. In addition, biasing components, including springs and tension members may be difficult to isolate physically and electrically from the movable conductive spanner. Thermal, electrical, and magnetic cycling of the contactor can result in mechanical damage to the biasing elements, particularly to the biasing springs. Such damage can take the form of burning, pitting, depositing of metal particles, or alteration of the material properties of the spring, leading to a reduction in its spring force over time, and consequent degradation in performance.

There is a need, therefore, an improved movable contact structure for electrical contact devices. In particular, there is a need for a movable contact structure which addresses the drawbacks of existing structures, providing both electrical and mechanical isolation of conductive elements within the movable contact structure from mechanical elements which may be subject to damage, as well as a structure which is both straight forward to assemble and replace. There is also a need for improved movable contact arrangements which are straightforward to assemble, install and replace as needed through the life of the device.

SUMMARY OF THE INVENTION

The invention provides a novel movable contact structure designed to respond to these needs. The structure benefits from a modular design wherein components are manufactured and assembled as units and thereafter associated with a carrier structure within the contact device. The modular subassemblies may be easily removed for servicing or replacement. The modular subassemblies may also include individual housings which facilitate electrical isolation of individual movable contact assemblies within a multi-phase contactor. The biasing elements employed for urging conducting elements of the movable contact subassembly are isolated from portions of the subassembly likely to experience arcing by walls or partitions included in the subassembly housing. The structure employs at least one biasing member which exerts a force against a region of the subassembly, such that additional tension members or assemblies are no longer required. In preferred configurations, the movable contact assemblies are easily accessible in the device housing, such that removal and replacement may be effected without requiring dismantling of stationary contact structures.

Thus, in accordance with a first aspect of the invention, a modular movable contact assembly is provided for an electrical contactor. The contact assembly includes an enclosure configured to be secured to a carrier for displacement within the contactor. A movable contact element including an electrically conductive body extends through the enclosure. First and second contact pads are disposed at first and second ends of the contact element. The first and second ends extend from the enclosure. At least one biasing member is disposed within the enclosure for urging the movable contact element toward a biased position. The biasing member may be a compression-type element exerting forces against a panel or side of the enclosure, and against the movable contact element. The biasing member preferably exerts a force against a side of the movable contact element opposite the first and second contact pads. Additional movable contact elements may be provided within the housing, each furnished with a biasing member urging the contact element towards a desired position. The housing may be securable to the carrier via one or more fasteners which extend through the housing.

In accordance with another aspect of the invention, a movable contact assembly for an electrical contactor is provided including a modular housing, a movable conductive element, and a compression member. The housing is configured to be secured to a carrier for displacing the contact assembly within the contactor. The movable conductive element has a central portion disposed within the housing and first and second contact pads disposed at first and second ends thereof outside the housing. The compression member is disposed intermediate the housing and the conductive element, and exerts a biasing force against the housing and the conductive element to urge the conductive element towards a contact position. The housing preferably includes sidewalls surrounding the central portion of the movable element and the compression member, thereby protecting these components from arcs and material which may be released during operation of the contactor. Again, the compression member preferably exerts a biasing force against a side of the movable contact element opposite the first and second contact pads. An interface portion may be provided on the housing and configured to be received by a carrier member for positioning and securement of the movable contact assembly to the carrier member.

In accordance with a further aspect of the invention, a contactor is provided for completing and interrupting electric current carrying paths between a source of electrical power and a load. The contactor includes a housing, an operator, stationary contacts, a carrier, and a movable contact assembly. The operator is disposed in the housing, as are the stationary contacts. The carrier is movable under the influence of the operator. The movable contact assembly is coupled to the carrier for movement with the carrier. The movable contact assembly includes a modular housing supported on the carrier, a conductive element disposed in the housing and having contact pads for selectively contacting the stationary contacts, and a biasing member exerting a biasing force on the housing and on the conductive element to urge the conductive element towards a contact position. Sidewalls may be provided in the modular housing for substantially surrounding the biasing member. A plurality of modular movable contact assemblies may be provided and supported on the carrier to form a polyphase contacting device. The movable contact assembly is preferably removable from the carrier by removal or loosening of a fastener, and does not require removal of components of the stationary contact structure.

In accordance with another aspect of the invention, a three-phase contactor is provided for completing and interrupting current carrying paths for three phases of electrical power. The contactor includes a housing, and operator and stationary contact sets disposed within the housing. The stationary contact sets are disposed in parallel arrangements within the housing, one set being provided for each phase of electrical power. A carrier is displaceable within the housing in response to energization and de-energization of the operator. A plurality of modular movable contact assemblies are removably supported on the carrier. One movable contact assembly is aligned with each stationary contact set. Each movable contact assembly includes a modular housing, a conductive element extending through the housing, and contact pads supported on the conductive element for contacting the associated stationary contact set. A biasing member is disposed in the housing for urging the conductive element toward a contact position. Each movable contact assembly may include a plurality of conductive elements and a corresponding plurality of biasing members, each urging a conductive element to a contact position. An interface surface on each module housing may facilitate its securement to the carrier. Each movable contact assembly may furthermore be independently removable from the carrier through an open end of the contactor housing. Again, the removal of the removable contact assemblies preferably does not require removal of either the carrier or the stationary contact assembly components from the housing.

BRIEF DESCRIPTION OF THE DRAWINGS

The foregoing and other advantages of the invention will become apparent upon reading the following detailed description and upon reference to the drawings in which:

FIG. 21 is a sectional view, along line 21—21, of the housing of FIG. 2, illustrating the orientation of internal partitions for separating the contactor and operator structures from one another, and the power phase sections from one another;

FIG. 22 is a partially broken bottom perspective view of the housing of FIG. 2, illustrating internal features of the housing and side walls thereof;

DETAILED DESCRIPTION OF SPECIFIC EMBODIMENTS

Figure 1:
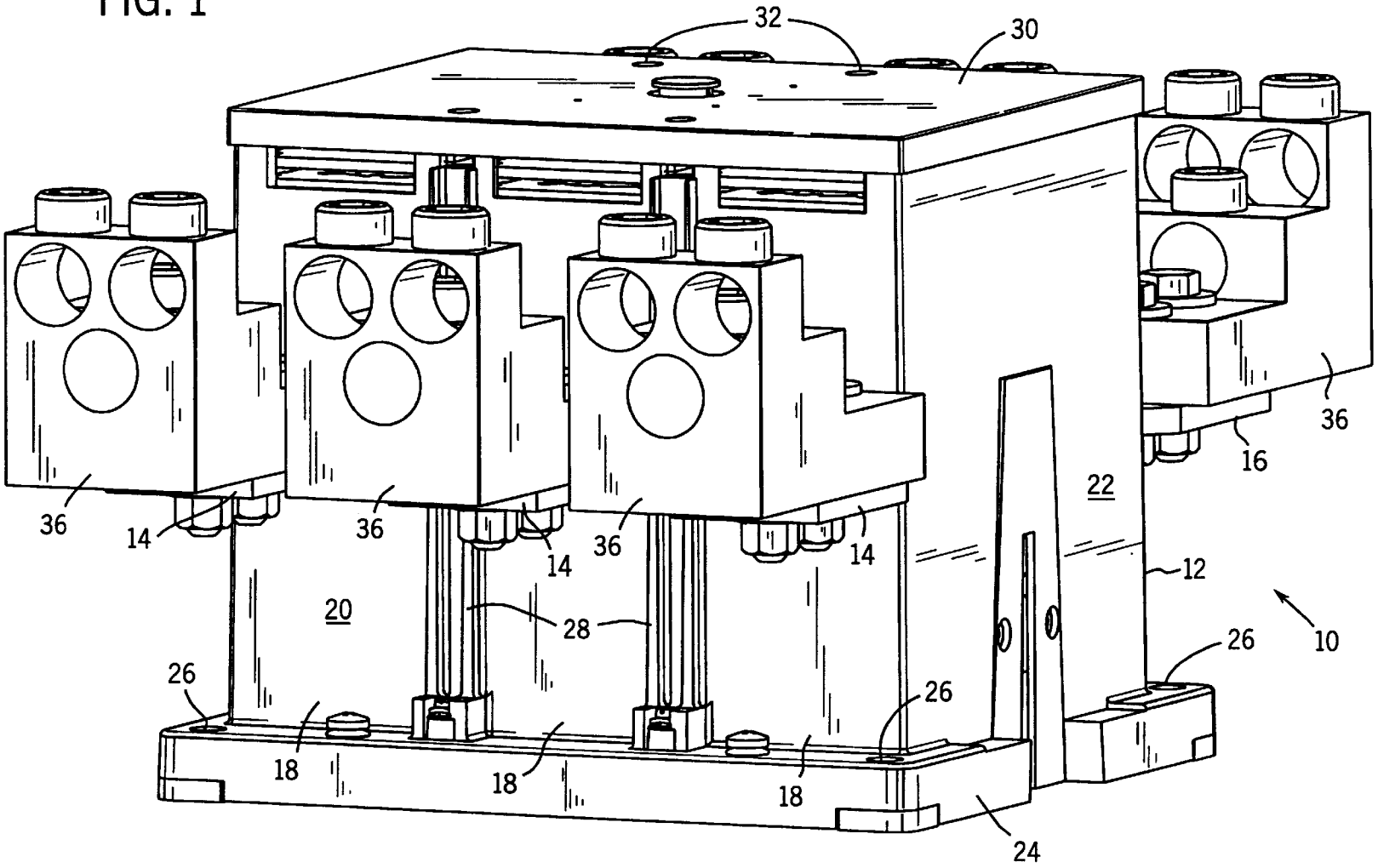
FIG. 1 is a perspective view of a three-phase contactor incorporating certain features of the present invention.

Turning now to the drawings, and referring first to FIG. 1, an electrical contactor 10 is illustrated in the form of a three-phase contactor for completing electrical current carrying paths for three separate phases of electrical power. Contactor 10 includes a housing 12 from which input or line terminals 14 and output or load terminals 16 extend. Contactor 10 is divided into three separate phase sections 18, with a pair of input and output terminals being associated with each phase section. Housing 12 includes end panels 20 and side walls 22 enclosing internal components as described more fully below. Input and output terminals 14 and 16 extend from end panels 20 for connection to power supply and load circuitry. Housing 12 further includes a lower securement flange 24 having apertures 26 formed therein for securing the contactor to a support base, such as in a conventional industrial enclosure (not shown). Ribs 28 are formed on end panels 20 to aid in electrically isolating phase sections 18 from one another, as more fully described below. A cover 30 extends over an upper region of housing 12 to cover internal components of the contactor. Cover 30 is held in place by fasteners (not visible in FIG. 1) lodged within fastener apertures 32 of cover 30. In the contactor illustrated in FIG. 1, wire lugs 36 are secured to both input and output terminals 14 and 16 for receiving and completing an electrical connection with current-carrying wires or cables of a conventional design.

Figure 2:
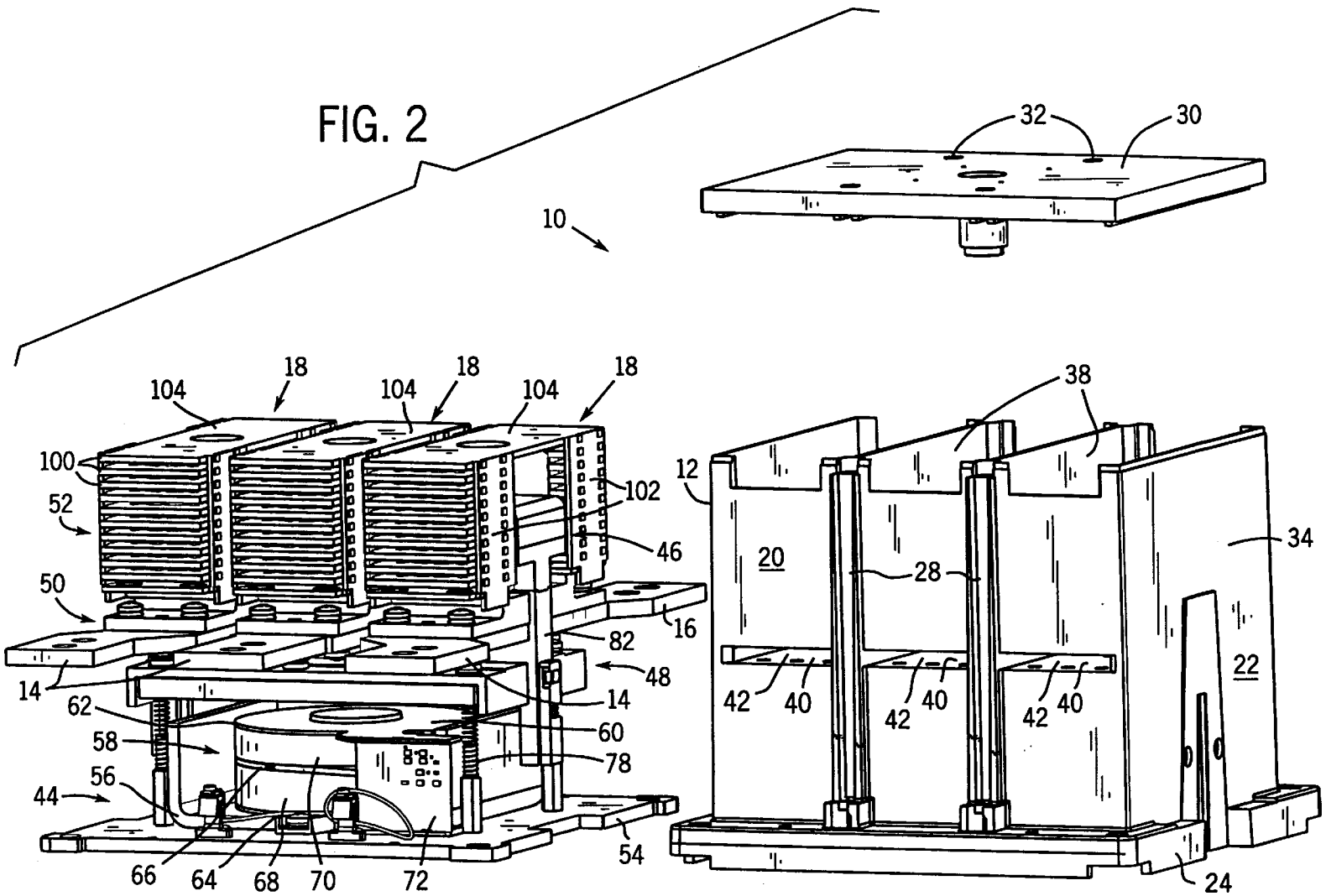
FIG. 2 is a perspective view of the contactor of FIG. 1, in which operative components of the contactor have been removed from the contactor housing to illustrate the various components and subassemblies.

FIG. 2 illustrates the housing, cover and internal operational components of the contactor of FIG. 1, separated for explanatory purposes. As indicated above, phase sections 18 of contactor 10 are divided within housing 12. Internal phase partitions 38 are provided as integral members of housing 12 for physically and electrically isolating the sections from one another. Also, as described below with particular reference to FIGS. 19 through 22, housing 12 preferably provides internal contact partitions 40, contiguous with phase partitions 38, for subdividing the internal volume of housing 12 into separate regions for contact subassemblies, and a lower region for housing an operator structure. Slots 42 are formed in end panels 20, permitting terminals 14 and 16 to extend from individual phase sections 18 lodged within housing 12 for conducting power to and from the contact assemblies.

In its various embodiments described herein, contactor 10 generally includes a series of subassemblies which cooperate to complete and interrupt current-carrying paths through the contactor. As shown in FIG. 2, the subassemblies include an operator assembly 44, movable contact assemblies 46, a carrier assembly 48, stationary contact assemblies 50, and splitter plate assemblies 52. Operator assembly 44, which is lodged in a lower region of housing 12 when assembled therein, serves to generate a controlled magnetic field for opening and closing the current-carrying paths through the contactor. The movable contact assemblies 46 are supported on carrier assembly 48 and move with carrier assembly 48 in response to the establishment and the interruption of magnetic fields generated by the operator assembly. The stationary contact assemblies 50, each coupled to input and output terminals 14 and 16, contact components of the movable contact assemblies 46 to establish and interrupt the currentcarrying paths through the contactor. Finally, splitter plate assemblies 52, positioned about movable contact assemblies 46, serve to dissipate and extinguish arcs resulting from opening and closing of the contactor, and dissipate heat generated by the arcs.

Figure 3:
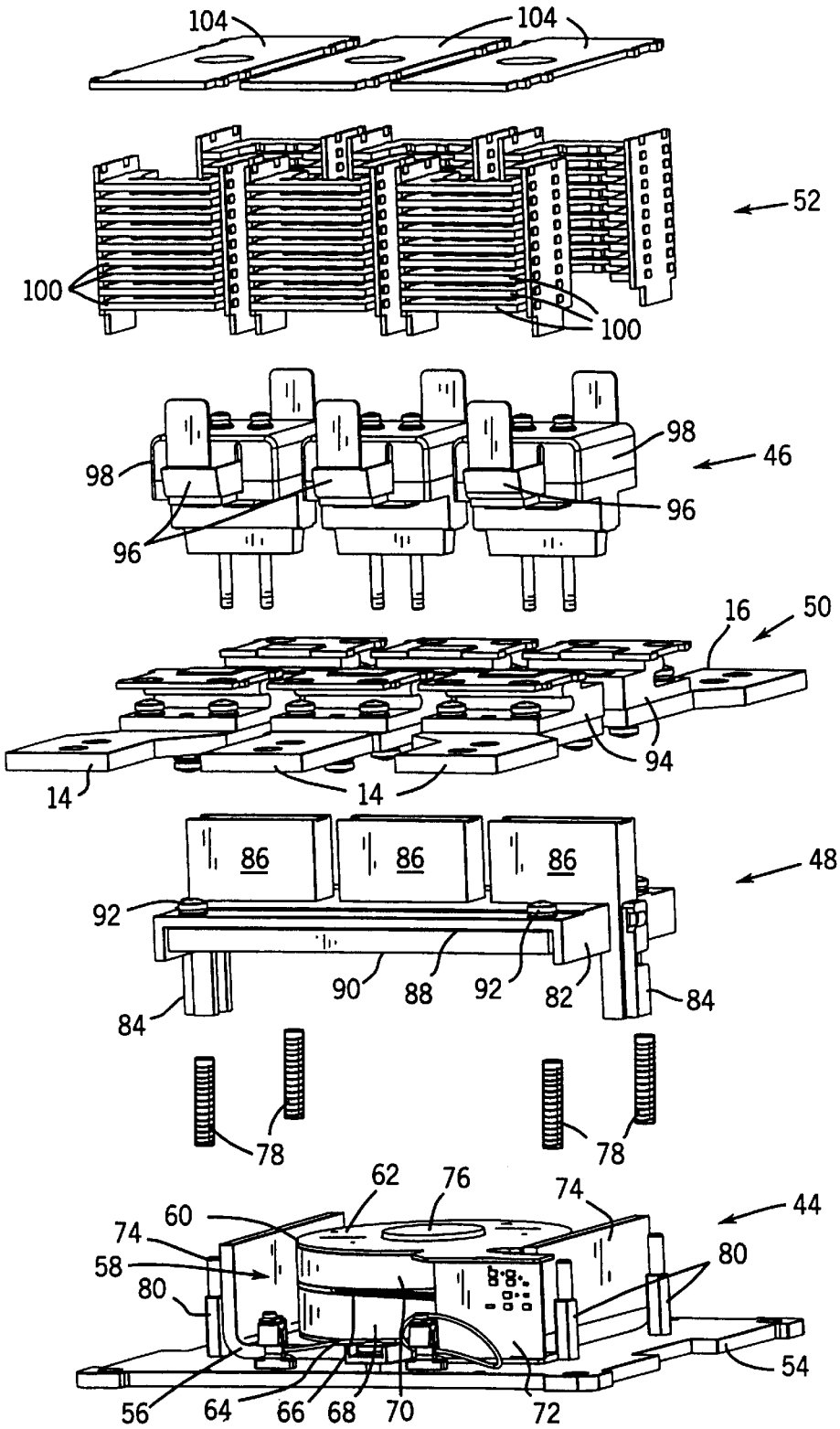
FIG. 3 is an exploded perspective view of certain of the subassemblies illustrated in FIG. 2, including movable and stationary contact structures, a movable contact carrier assembly, and a magnetic operator coil assembly.

The foregoing subassemblies are illustrated in an exploded perspective view in FIG. 3. Referring more particularly to the illustrated arrangement of operator assembly 44, in a presently preferred embodiment, operator assembly 44 is capable of opening and closing the contactor by movement of carrier assembly 48 and movable contact assemblies 46 under the influence of either alternating or direct current control signals. Operator assembly 44, thus, includes a base or mounting plate 54 on which an yoke 56 and coil assembly 58 are secured. While yoke 56 may take various forms, in a presently preferred configuration, it includes a unitary shell formed of a ferromagnetic material, such as steel, providing both mechanical support for coil assembly 58 as well as magnetic field enhancement for facilitating actuation of the contactor with reduced energy input as compared to conventional devices.

Coil assembly 58 is formed on a unitary bobbin 60 made of a molded plastic material having an upper flange 62, a lower flange 64, and an intermediate flange 66. Bobbin 60 supports, between the upper, lower and intermediate flanges, a pair of electromagnetic coils, including a holding coil 68 and a pickup coil 70. As described more fully below, a preferred configuration of coil assembly 58 facilitates winding and electrical connection of the coils in the assembly. Also as described below, in a presently preferred configuration, the holding and pickup coils may be powered with either alternating current or direct current energy, and are energized and de-energized in novel manners to reduce the energy necessary for actuation of the contactor, and to provide a fast-acting device. Coil assembly 58 also supports a control circuit 72 which provides the desired energization and de-energization functions for the holding and pickup coils.

Yoke 56 forms integral side flanges 74 which extend upwardly adjacent to coil assembly 58 to channel magnetic flux produced during energization of coils 68 and 70 during operation. Moreover, in the illustrated embodiment, a central core 76 is secured to yoke 56 and extends through the center of bobbin 60. As will be appreciated by those skilled in the art, side flanges 74 and core 76 thus form a flux-channeling, U-shaped yoke which also serves as a mechanical support for the coil assembly, and interfaces the coil structure in a subassembly with base plate 54. As described more fully below, operator assembly 44 may be energized and de-energized to cause movement of movable contact assemblies 46 through the intermediary of carrier assembly 48.

As best illustrated in FIG. 3, biasing springs 78 are supported by spring guide posts 80 of operator assembly 44 to bias carrier assembly 48 is an upward direction. Carrier assembly 48 includes a unitary carrier piece 82 which spans operator assembly 44 when assembled in the contactor. Carrier piece 82 includes linear bearing members 84 at either end thereof. Linear bearing numbers 84 contact and bear against slots formed in the contactor housing, as described in greater detail below, to maintain alignment of the carrier piece in its translational movement during actuation of the contactor. Carrier piece 82 also includes a series of mounting features 86 for receiving and supporting movable contact assemblies 46. At a base of mounting features 86, carrier piece 82 forms a movable armature support to which a ferromagnetic armature 90 is secured via fasteners 92. Armature 90 serves to draw carrier assembly 48 toward operator assembly 44 during operation, thereby displacing movable contact assemblies 46. A rubber cushion piece 88 is disposed between carrier piece 82 and armature 90 to cushion impact between the components resulting from rapid movement of the carrier assembly and armature during operation.

As discussed throughout the following description, in the presently preferred embodiments, the mass of the various movable components of the contactor is reduced as compared to conventional contactor designs of similar current and voltage ratings. In particular, a low mass movable armature 90 is preferably used to draw the carrier assembly toward the operator assembly during actuation of the device, providing increased speed of response due to the reduced inertia. Also, the use of a lighter movable armature permits the use of springs 78 which urge the carrier assembly towards a normal or biased position, of a smaller spring constant, thereby reducing the force required of the operator assembly for displacement of the carrier assembly and actuation of the device.

As illustrated in FIG. 3, stationary contact assemblies 50 are disposed on either side of carrier assembly 48. A pair of such stationary contact assemblies is associated with each power phase of the contactor. Moreover, each stationary contact assembly includes a stationary contact structure 94, preferred configurations of which are described in greater detail below. Stationary contacts 94 are coupled to input and output terminals 14 and 16, and serve to complete current-carrying paths through the contactor upon closure with movable contact assemblies 46.

In the present embodiment illustrated in FIG. 3, movable contact assemblies 46 each comprise modular assemblies which can be easily installed into the contactor, and removed from the contactor for replacement or servicing. Accordingly, a modular movable contact assembly 46 is provided for each power phase, and functions with a corresponding pair of stationary contact assemblies 50. Each modular movable contact assembly 46 includes movable contacts 96 supported in a modular housing 98. The preferred arrangement of movable contact assemblies 46 both facilitates assembly of the components thereof as well as protects internal components, such as biasing members from arcing and material debris which may be released during opening and closing of the contactor. Splitter plate assemblies 52 are assembled as modular components positioned on either side of movable contact assemblies 46. Each splitter plate assembly 52 includes a series of splitter plates 110 assembled in vertical parallel arrangement supported by lateral plate supports 102. Above each pair of splitter plate assemblies 52, a shunt plate 104 is provided for each power phase section. Shunt plates 104 serve to complete temporary current-carrying paths upon opening and closing of the contactor in a manner generally known in the art.

STATIONARY CONTACT ASSEMBLIES

Figure 4:
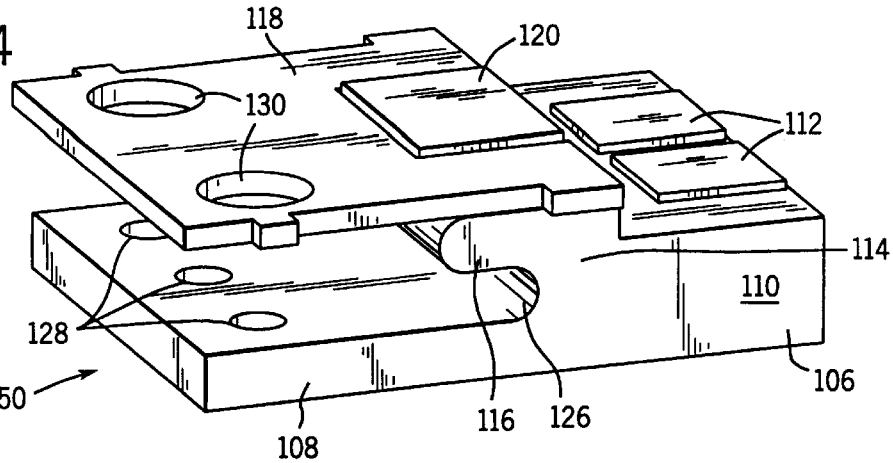
FIG. 4 is a perspective view of a stationary contact structure in accordance with one presently preferred embodiment, for use in a contactor subassembly of the type shown in FIG. 3.
Figure 5:
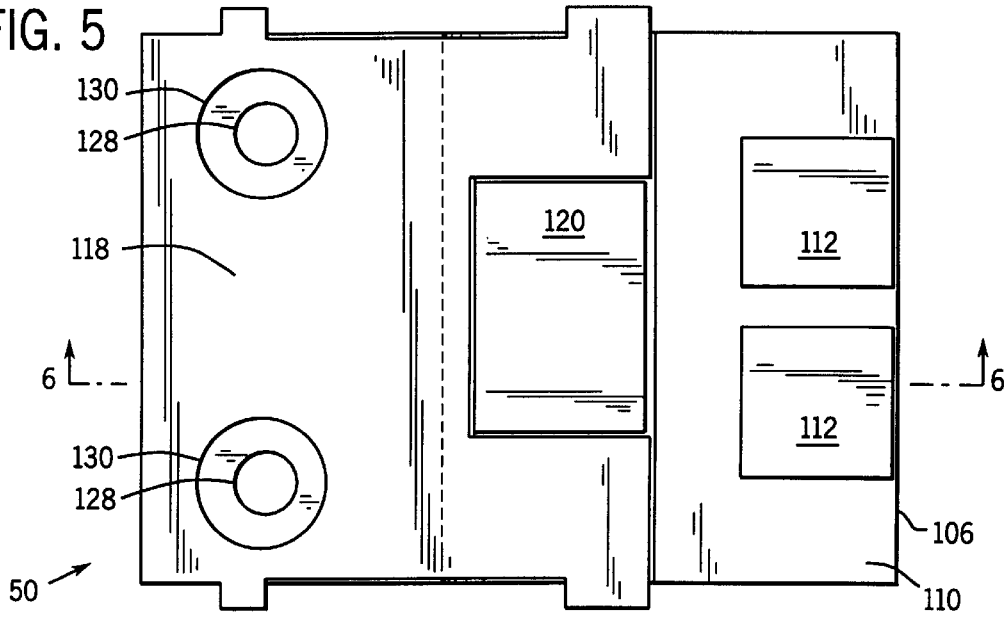
FIG. 5 is a top plan view of the stationary contact structure of FIG. 4, illustrating the position of contact pads and other elements of the stationary contact structure.
Figure 6:
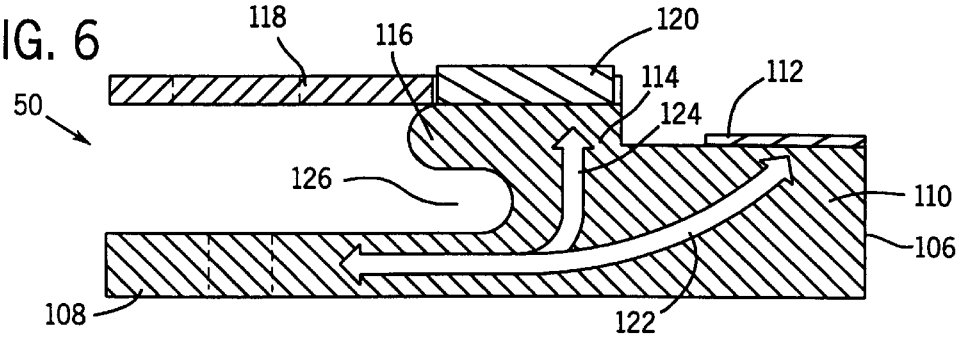
FIG. 6 is a sectional view of the contact structure of FIG. 5 along line 6—6, illustrating current flow paths defined during operation of the stationary contact.

Referring more particularly now to preferred embodiments of stationary contact assemblies 50, a first preferred embodiment for each such assembly is illustrated in FIGS. 4, 5 and 6. As shown in FIG. 4, each stationary contact assembly 50 includes a base component 106 integrally forming certain desired features for conducting electrical current both during steady-state operation and during transient operation (i.e., during opening and closing of the contactor). Thus, base 106 in FIG. 4 forms a terminal attachment section 108 and a current-carrying extension 110 generally in line with terminal attachment section 108. Current-carrying contacts 112 are disposed on an upper surface of current-canying extension 110 for conducting current into or out of the base 106 during steady-state operation. Base 106 also forms a riser portion 114 which extends generally perpendicularly to a terminal attachment section 108 and current-carrying extension 110. At an upper end of riser of portion 114, a turnback 116 is formed. In the presently preferred embodiment illustrated, riser portion 114 is generally perpendicular to both a turnback portion 116 and to the current-carrying flow path defined by terminal attachment section 108 and current-carrying extension 110. An arc guide 118 is secured to an upper face of turnback portion 116 to lead arcs which may be generated during opening and closing of the contactor in a direction toward splitter plate assemblies 52 (see FIG. 3). Arc guide 118 extends around an arc contact 120 which also is secured to the upper face of turnback portion 116 over riser portion 114.

As best illustrated in FIG. 6, the foregoing arrangement of base 106, including terminal attachment section 108, current-carrying extension 110, riser 114 and turnback portion 116, permits current-carrying paths to be defined within each stationary contact assembly 50 which provide enhanced performance as compared to conventional structures. Particularly, a generally linear current-carrying path 122 is defined between terminal attachment section 108 and current-carrying contacts 112 supported on extension 110. In FIG. 6, this current-carrying path is illustrated as bidirectional. However, in practice, the direction of a current flow will generally be defined by the orientation of the stationary contact in the contactor (i.e., coupled to the source or load).

During opening and closing of the contactor, a different current-carrying path is defined as illustrated by reference numeral 124. This current-carrying path extends at an angle from path 122. Moreover, path 124 terminates in arc contact 120 which overlies riser 114. Thus, immediately following opening of the contactor (i.e., movement of the movable contact elements away from the stationary contacts), the steady state path 122 is interrupted, and current flows along path 124. Arcs developed by separation of movable contact elements from the stationary arc contact 120 initially extend directly above riser 114, and thereafter are forced to migrate onto turnback portion 116 and then onto arc guide 118, expanding the arcs and dissipating them through the adjacent splitter plates. Any residual current flow is then channeled along the splitter plate stack to the shunt plates 104 (see, e.g., FIG. 3) positioned above the splitter plates.

It has been found that this current-carrying path 122 established during transient phases of operation results in substantially reduced magnetic fields within the stationary contact opposing closing movement of the carrier assembly and movable contacts. As will be appreciated by those skilled in the art, conventional stationary contact structures, wherein steady-state or arc contacts are provided in a turnback region, or wherein contacts are provided on a bent or curved turnback/riser arrangement, magnetic fields can be developed which can significantly oppose the contact spring force and movement of the movable contact assemblies and associated armature. By virtue of the provision of riser 114 and the location of arc contact 120 substantially above the riser, thus defining path 124, it has been found that the force, and thereby the energy, required to close the contactor is substantially reduced.

To facilitate formation of the desired features of the stationary contact assembly 50, and particularly of base 106, base 106 is preferably formed as an extruded component having a profile as shown in FIG. 6. As will be appreciated by those skilled in the art, such extrusion processes facilitate the formation of terminal attachment section 108, extension 110, riser 114 and turnback 116, and permit a recess 126 to be formed beneath the turnback 116. The extrusion may be made of any suitable material, such as high-grade copper. Alternatively, casting processes may be used to form a similar base of structure. Following formation of base 106 (e.g., by cutting a desired width of material from an extruded bar), contacts 112 and 120 are bonded to base 106. In a presently preferred arrangement, contacts 112 are made of silver or a silver alloy, while contact 120 is made of a conductive yet durable material such as a copper-tungsten alloy. Arc guide 118 is also bonded to base 106 and is made of any suitable conductive material such as steel. The resulting structure is then silver plated to cover conductive surfaces by a thin layer of silver. As best illustrated in FIGS. 4 and 5, prior to such assembly, apertures 128 are formed in base 106, and apertures 130 are formed in arc guide 118, to facilitate placement of fasteners (not shown) for securing the stationary contact assembly in this housing and for securing terminal conductors to the stationary contact assemblies during assembly of the contactor.

Figure 7:
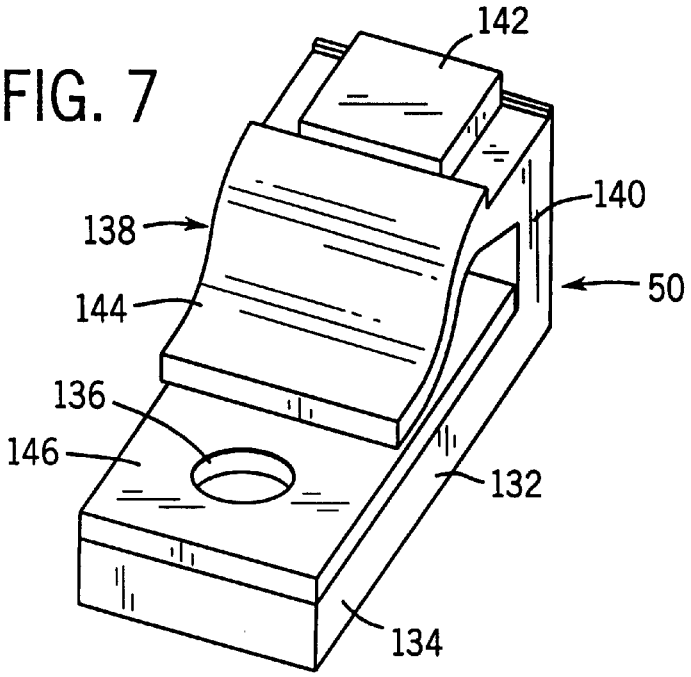
FIG. 7 is a perspective view of an alternative stationary contact structure for use in a contactor in accordance with the present techniques.
Figure 8:
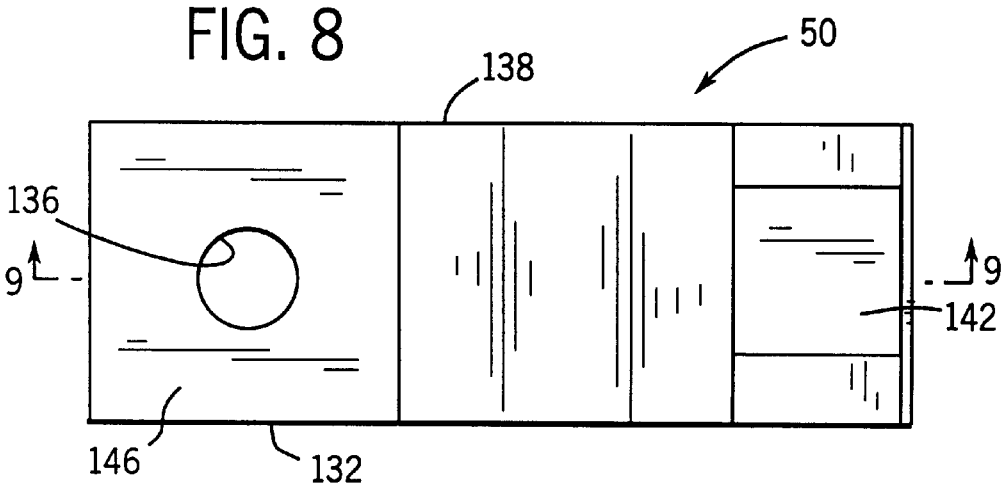
FIG. 8 is a top plan view of the contact structure of FIG. 7.
Figure 9:
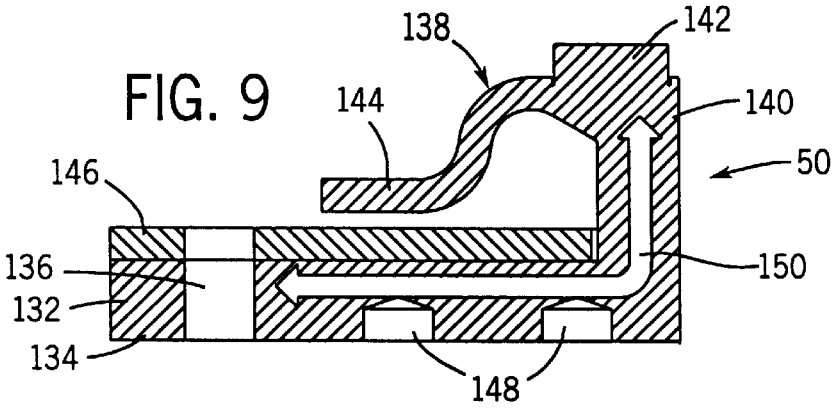
FIG. 9 is a sectional view of the stationary contact structure of FIG. 8, along line 9—9, illustrating current flow paths defined during operation of the stationary contact structure.

An alternative configuration for a stationary contact assembly in accordance with certain aspects of the present technique is illustrated in FIGS. 7, 8 and 9. The arrangement of FIGS. 7, 8 and 9 is particularly well suited to smaller-size contactors, having lower current-carrying or power ratings. In this embodiment, each stationary contact assembly 50 includes a base 132 forming a current-carrying extension 134 designed to be secured to a terminal conductor. Accordingly, current-carrying extension 134 includes an aperture 136 for receiving a fastener (not shown) for this purpose. A turnback portion 138 is formed at least partially over a current-carrying extension 134, and is integral with extension 134 through the intermediary of a riser 140. Riser 140 forms an angle with extension 134, preferably extending generally perpendicular to the extension. Directly above riser 140, a contact 142 is provided. From the location of contact 142, turnback portion 138 forms a descending extension 144 which curves downwardly toward current-carrying extension 134 (see, e.g., FIG. 9). A shunt plate 146 is bonded to extension 134 below extension 144, and includes a fastener aperture 136 generally in line with the corresponding aperture of base 132. Finally, a pair of fastener-receiving recesses or bores 148 are formed in a lower face of base 132 for facilitating of mounting and alignment of the base in the contactor.

The foregoing structure of stationary contact assembly 50 offers several advantages over heretofore existing structures. For example, as in the case of both embodiments described above, a current-carrying path is defined in the assembly base which substantially reduces the force required for actuation and holding of the contactor. As shown in FIG. 9, this current-carrying path, designated by reference numeral 150, extends through current-carrying extension 134, riser 140, and directly through contact 142. Forces resulting from electromagnetic fields generated during opening and closing of the contactor, which attempt to oppose movement of the movable armature and movable contact structures in conventional devices or which oppose current flow through the stationary contacts, are substantially reduced by positioning of contact 142 over riser 140.

Figure 10:
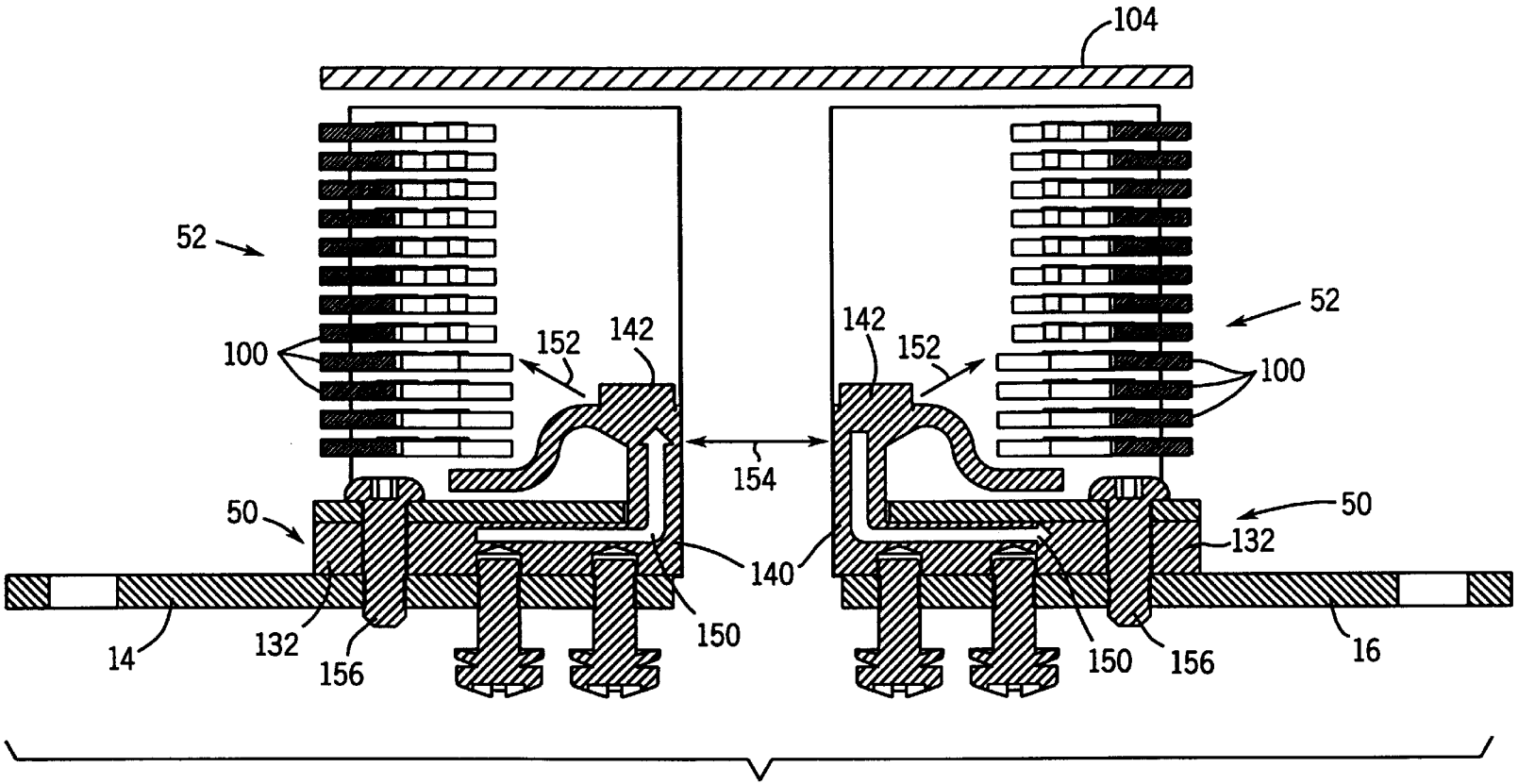
FIG. 10 is a sectional view of a pair of stationary contact structures of the type shown in FIGS. 7, 8 and 9, disposed as they would be in an assembled contactor.

Moreover, in the embodiment of FIGS. 7, 8 and 9, the provision of a descending extension 144 on turnback 138 permits arcs to be channeled to splitter plates 100 at a substantially lower location along the stack of splitter plates than in conventional devices, as indicated by reference number 152 in FIG. 10. As in the foregoing embodiment, arcs generated during opening and closing of the device are initially channeled generally upwardly above riser 140. The arcs subsequently migrate along turnback 138 toward splitter plates 100, where they are dissipated and conveyed upwardly to a shunt plate positioned above the stack.

In a presently preferred embodiment illustrated, arcs generated during opening and closing of the contactor are channeled to the fourth or fifth splitter plate from a bottom-most plate, dissipating the arcs in the lower splitter plates in the stack, adjacent to or slightly above the level of contact 142, and forcing rapid extinction of the arcs by introduction at a lower location and into multiple plates in the stack. Also shown in FIG. 10, the preferred configuration for base 132 facilitates positioning of the stationary contacts in close proximity to one another, as indicated by reference numeral 154 in FIG. 10. Those skilled in the art will recognize that this is in contrast to arrangements obtainable through the use of heretofore known contact structures wherein a turnback portion was formed by bending a single piece of metallic conductor. Again, the reduction in spacing between the stationary contact structures substantially helps to reduce the force and thereby the power required to close the device and maintain it in a closed position. Also shown in FIG. 10, the foregoing structure facilitates mounting of the stationary contacts by means of fasteners 156 extending through apertures 136.

As noted above with respect to the embodiment of FIGS. 4, 5 and 6, the embodiment of FIGS. 7, 8, 9 and 10 is preferably formed by an extrusion process, thereby facilitating formation of descending extension 144 and risers 140. Shunt plate 146 may be made of any suitable material, such as a steel plate. Plate 146 provides a short circuit path for flux generated during passage of current through current-carrying extension 134, thereby reducing field interaction between extension 134 and turnback portion 138. It should also be noted that in the embodiment illustrated in FIGS. 7, 8, 9 and 10, turnback 138 is of a substantially reduced thickness as compared to current-carrying extension 134 and riser 140. Because the turnback is subjected to high transient temperatures during opening and closing of the contactor, the reduced thickness permits rapid cooling of the turnback. Similarly, the enhanced thickness of extension 132 and riser 140 aids in drawing thermal energy away from contact pad 142. Again, the formation of the reduced thickness turnback 138 is facilitated by extrusion of base 132.

MOVABLE CONTACT ASSEMBLIES

Figure 11:
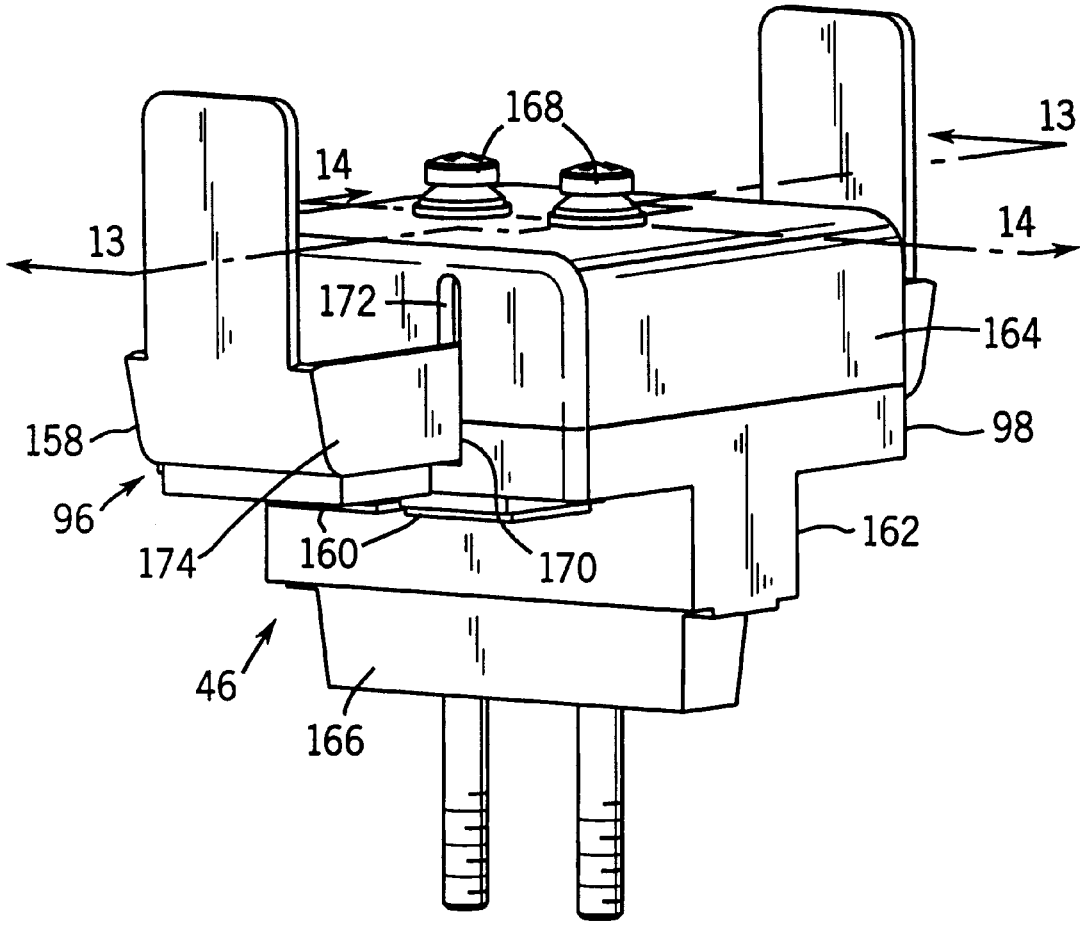
FIG. 11 is a perspective view of a movable contact module for use in a contactor of the type shown in FIG. 1.

Presently preferred configurations for movable assemblies 46 are illustrated in FIGS. 11–18. In a first preferred embodiment for these structures, shown in FIGS. 11, 12, 13 and 14, the movable contact assemblies each include separate movable structures for completing current-carrying paths during transient operation of the contactor, and during steady-state operation. In particular, as shown in FIG. 11, an arc carrying spanner assembly 158 is provided for initially completing a contact between pairs of stationary contact assemblies for each phase section during closure of the device. Separate current-carrying contact spanner assemblies 160 are provided for carrying electrical current during steady-state operation. Upon opening of the contactor, current-carrying contact spanner assemblies 160 undergo an initial movement, followed by movement of arc contact spanner assemblies 158, thereby forcing any arcing during opening or closure of the device between the arc contact spanner assemblies 158 and corresponding structures of the stationary contact assemblies.

Figure 12:
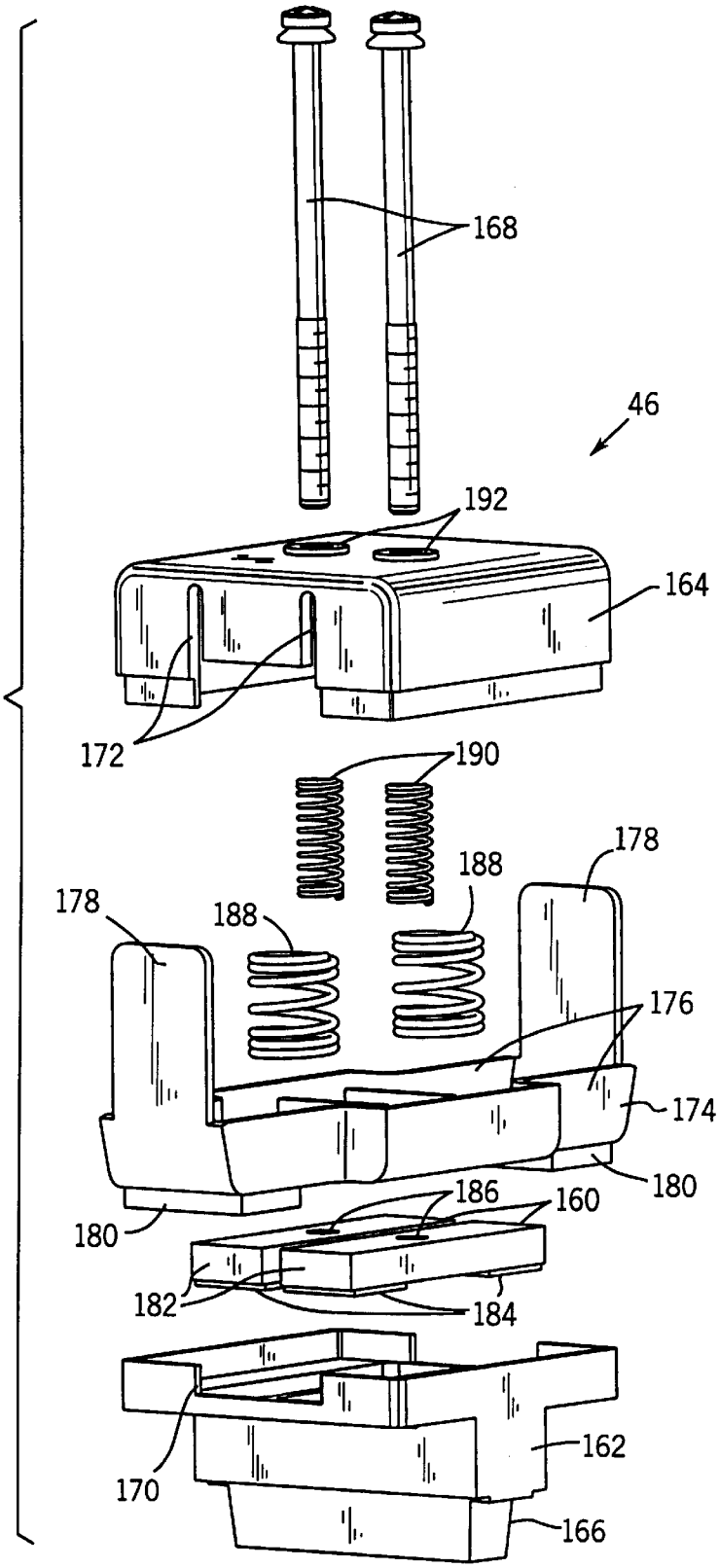
FIG. 12 is an exploded view of the movable contact module of FIG. 11, illustrating in greater detail the various components of the module.

As best illustrated in FIGS. 11 and 12, each movable contact assembly 46 in this embodiment includes a housing base 162 designed to receive and to interface with a housing cover 164. The housing base and cover enclose internal components, including central regions of arc contact spanner assembly 158 and current-carrying contact spanner assemblies 160, these assemblies extending from the housing to face portions of the stationary contact assemblies. An interface portion 166 extends from each housing base 162 and is configured to be securely seated within a mounting feature 86 (see FIG. 3) of carrier piece 82. Moreover, fasteners 168 extend through both housing base 162 and housing cover 164, protruding from interface portion 166 to secure the assembled movable contact module to the carrier piece as described more fully below.

Housing base 162 and cover 164 are configured to support the contact spanner assemblies 158 and 160, while allowing movement of the contact assemblies during operation. Accordingly, a lower face of housing base 162 is open, permitting current-carrying contact assemblies 162 to extend therethrough, as shown in FIG. 11. Furthermore, recesses 170 are formed in lateral end walls of housing base 162 for receiving a lower face of arc contact spanner assembly 158. Slots 172 are formed above recess 170, in housing cover 164. In the illustrated embodiment arc contact spanner assembly 158 forms a hollow spanner 174 having side walls 176 which engage slots 172 when assembled in the housing. Slots 172 engage these side walls to aid in guiding the contact spanner assembly 158 in translation upwardly and downwardly as contact is made with stationary contact pads as described below. At ends of spanner 174, arc contact spanner assembly 158 forms arc guides 178 which extend upwardly and aid in drawing arcs toward splitter plates in the assembled device. Adjacent to arc guides 178, spanner 174 carries a pair of contact pads 180. Below arc contact spanner assembly 158 in housing base 162, each current-carrying contact spanner assembly 160 includes a spanner 182 formed of a conductive metal such as copper. Each spanner terminates in a pair of contact pads 184. Apertures 186 are formed in each spanner 182 to permit passage of fasteners 168 therethrough.

Figure 14:
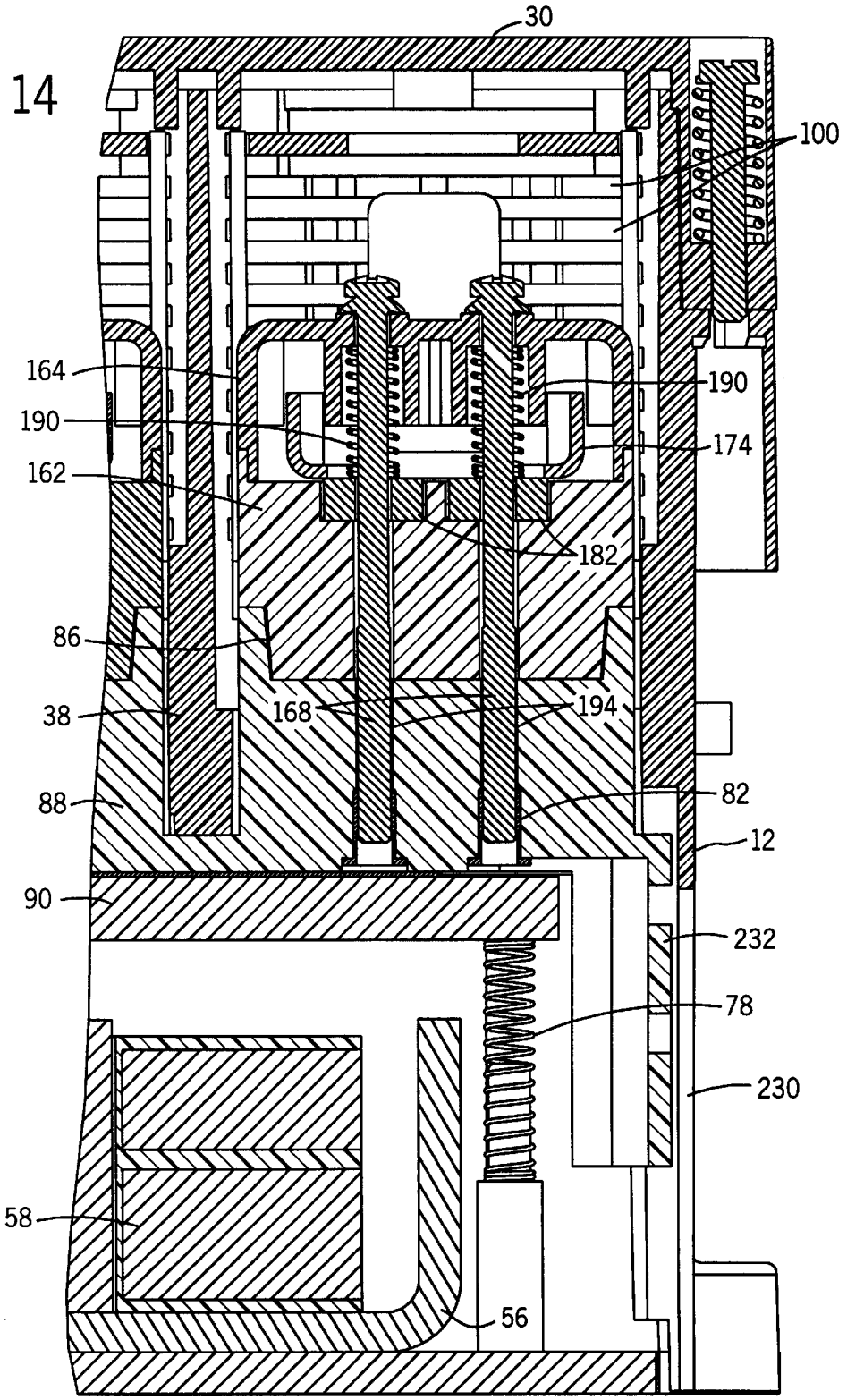
FIG. 14 is a transverse section of the contact module of FIG. 11, along line 14—14, also shown in its installed position within a contactor of the type shown in FIG. 1.

Contact spanner assemblies 158 and 160 are held in biased positions by biasing components which are shrouded from heat and debris within the contactor by the modular housing structure. As best illustrated in FIG. 12, a pair of compression springs 188 are provided for urging arc contact spanner assembly 158 in a downward orientation in the illustrated embodiment. Springs 188 bear against housing cover 164, but permit vertical translation of arc contact spanner assembly 158 during operation. Another pair of biasing springs 190 are provided for each current-carrying contact spanner assembly 160. These springs also bear against housing cover 164, and urge spanners 182 to a lower biased position. In the illustrated embodiment, springs 190 are aligned with apertures 192 formed in housing cover 164, and fit loosely around fasteners 168 when installed in the movable contact assembly, as best shown in FIG. 14. A pair of threaded apertures 194 are provided in carrier piece 82 to receive fasteners 168 for securement of each movable contact assembly in the carrier. Threaded inserts may be provided at the base of each aperture for interfacing with the fasteners.

Figure 13:
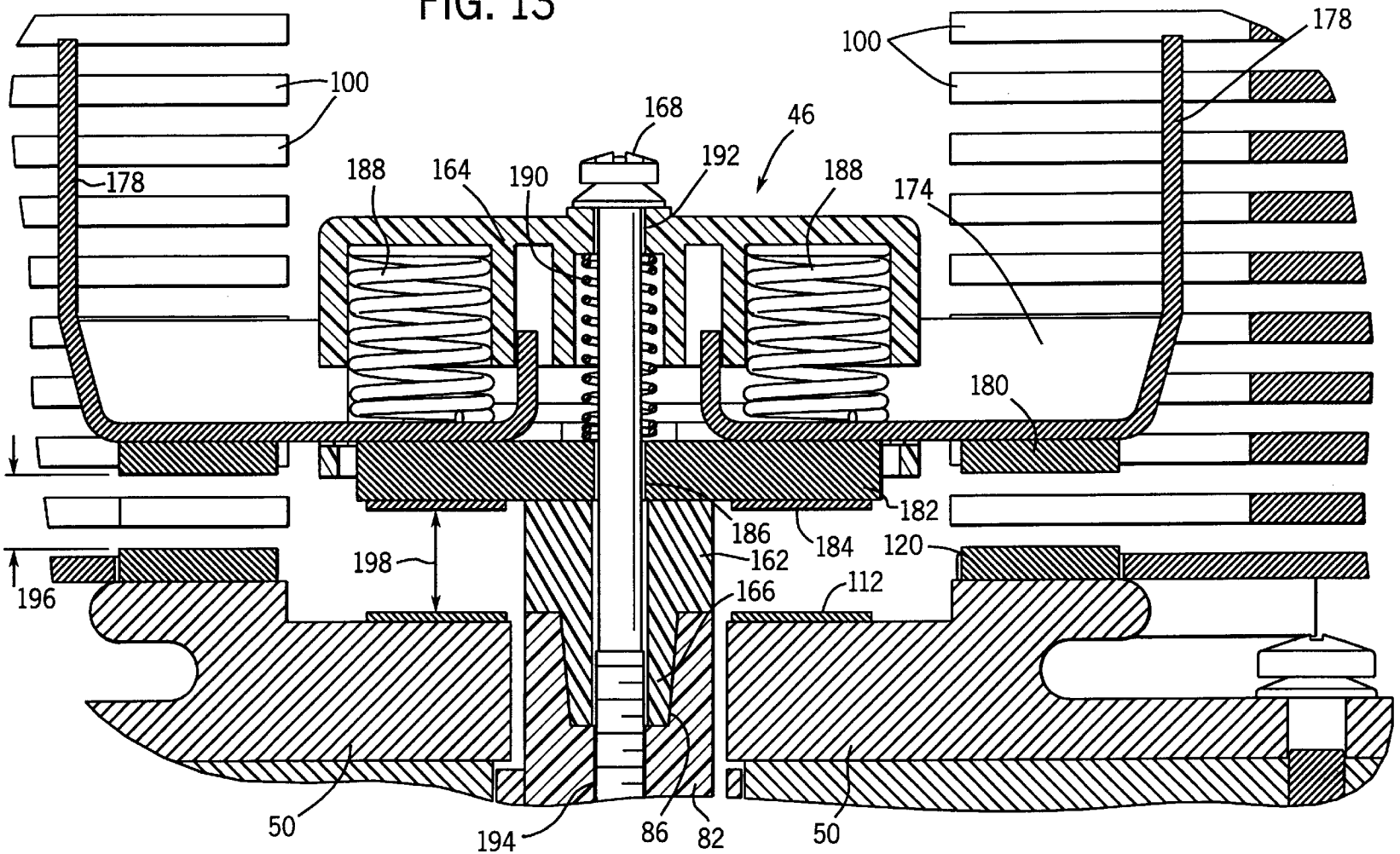
FIG. 13 is a partial sectional view of a contact structure of the type shown in FIG. 11, along line 13—13, illustrating the position of the various components as they would be installed in a contactor of the type shown in FIG. 1.

As best illustrated in FIGS. 13 and 14, in this embodiment, each movable contact assembly 46 is received within a corresponding mounting feature 86 of carrier piece 82. The entire carrier assembly, including the movable contact assemblies, is biased in an upward direction by springs 78 disposed adjacent to yoke 56 in the operator portion of the contactor. To permit the arc contact spanner assemblies 158 to complete the current-carrying paths through the contactor prior to the current-carrying contact assemblies, and to interrupt the current-carrying path after movement of the current-carrying contact assemblies, contact pads 180 are spaced from stationary contacts 120 by a distance as indicated by reference number 196 in FIG. 13. The contact pads provided on spanners 182 of the current-carrying contact assemblies are spaced from stationary contacts 112 by a greater distance as indicated by reference numeral 198. Thus, arcs produced during opening and closing of the contactor will primarily occur between contacts 180 and 120, and will be led away from contacts 180 and 120 by the arc guiding structures of the stationary contact assemblies and by arc guides 178 of the arc contact assemblies. It should be noted that the internal components of the movable contact assemblies, particularly springs 188 and 190, are shielded from such arcs, and from debris which may result from opening and closing of the contactor, by the housing provided around each movable contact assembly. In addition, the movable contact assemblies are independently removable and replaceable by simply removing fasteners 168, and lifting the modular assembly from mounting feature 86 within carrier piece 82. Thus, replacement of one or more of the assemblies, or of all or a portion of each movable contact assembly does not require disassembly of the entire contactor, or removal of the stationary contact assemblies.

Figure 15:
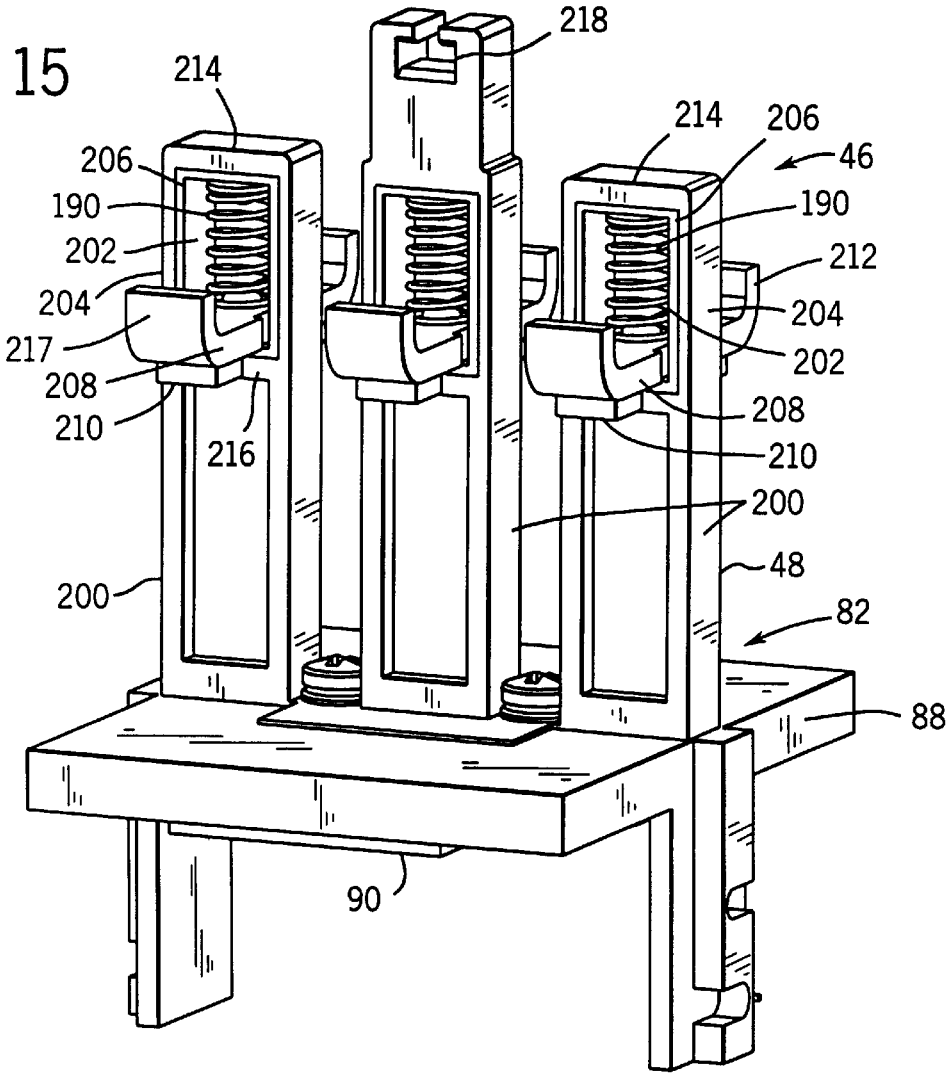
FIG. 15 is a perspective view of an alternative configuration for modular movable contact structures positioned in a three-phase carrier assembly.

A second preferred configuration for the movable contact assemblies is illustrated in FIGS. 15, 16, 17 and 18. As shown in FIG. 15, in this embodiment the carrier piece 82 may include a series of risers 200 which extend. A slot 202 is formed in each riser for receiving a modular movable contact assembly. Thus, at an upper end of each riser 200, a housing 204 is formed against which the movable contact assembly bears during operation. In a presently preferred configuration, a slip or press-in insert 206 is provided around an inner periphery of each housing 204 to facilitate insertion of the movable contact assembly and to bear against portions of the assembly during operation. A spanner 208 is provided within each housing 204 and carries a pair of contacts 210. Adjacent to each contact pad, arc guides 212 are formed to lead arcs created during opening and closing of the contactor toward splitter plate assemblies as described above.

Figure 16:
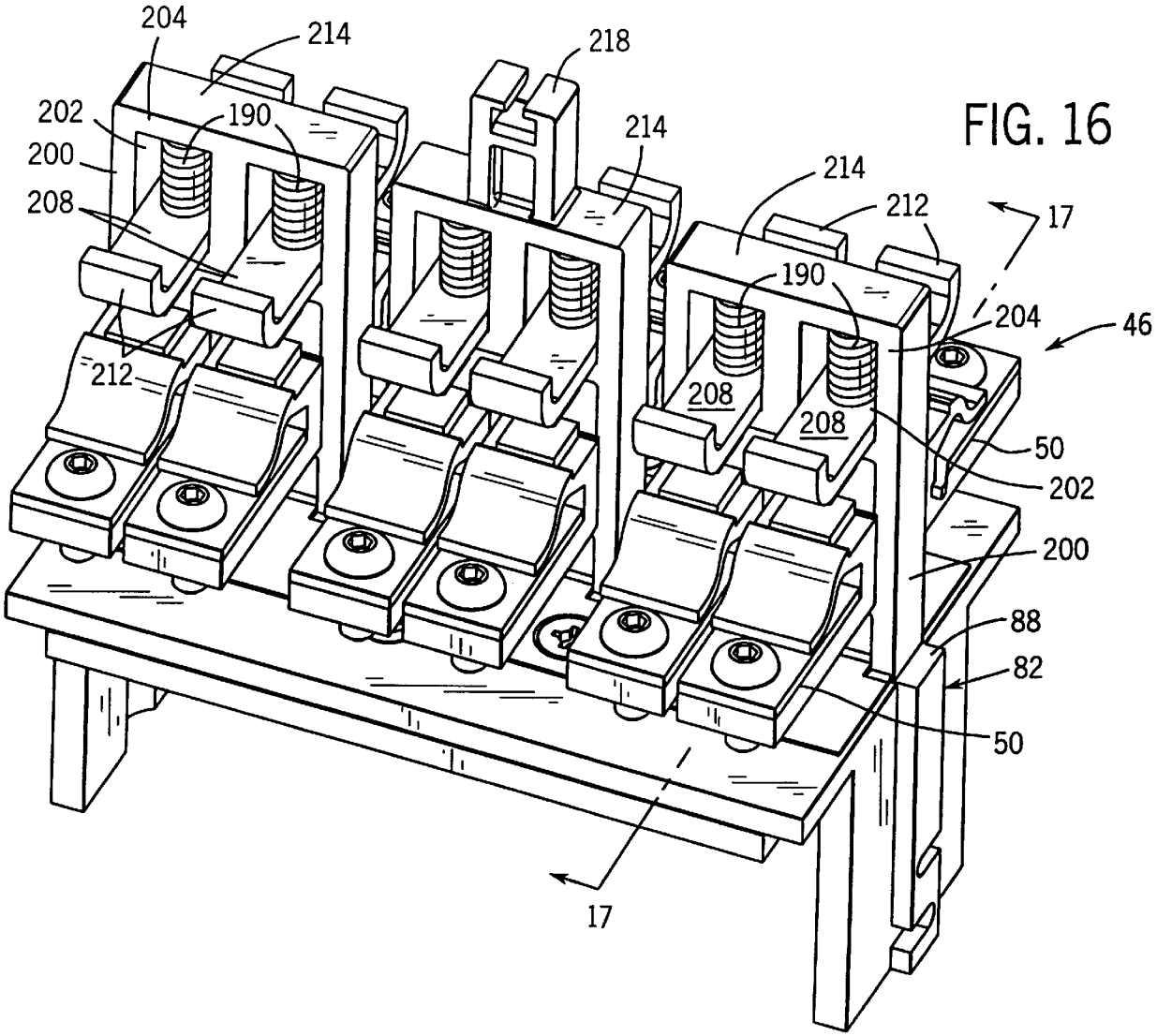
FIG. 16 is a perspective view of an alternative arrangement for stationary contact structures of the type shown in FIG. 15, including multiple current-carrying elements for each power phase.
Figure 17:
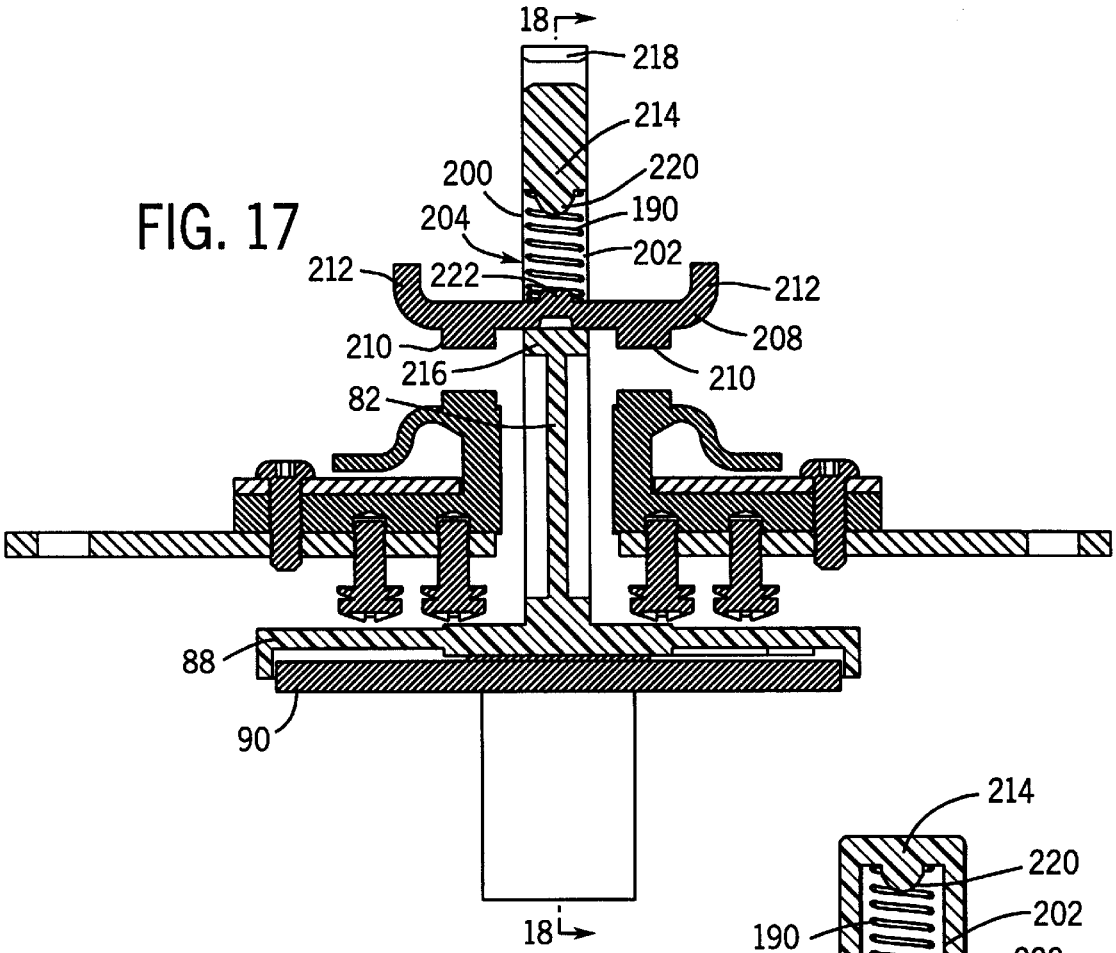
FIG. 17 is a sectional view of one of the movable contact structures of FIG. 16, along line 17—17.
Figure 18:
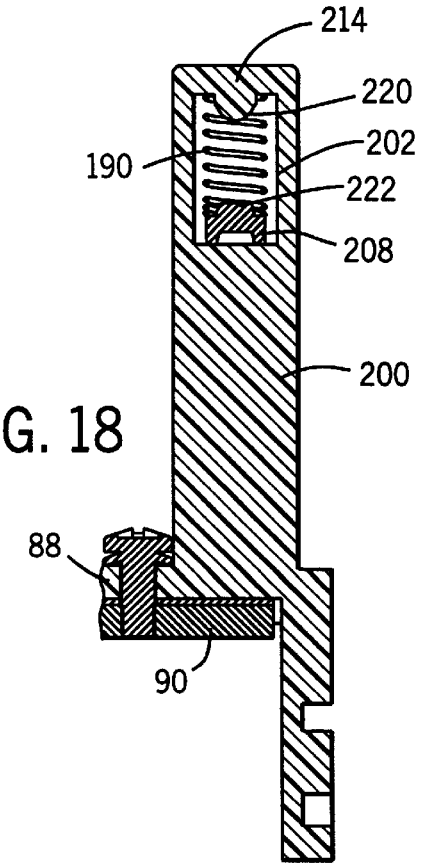
FIG. 18 is a transverse section of the movable contact arrangements of FIG. 17.

As in the foregoing embodiment, forces created for biasing of the movable contact assemblies illustrated in FIGS. 15–18 are preferably compressive forces which are opposed by the modular housing structure. Accordingly, as best illustrated in FIGS. 15, 17 and 18, housing 204 forms an upper wall 114 and a lower wall 116 against which such compressive forces are exerted. Above upper wall 114 of a center housing, an auxiliary switch interface 118 is formed for receiving a modular auxiliary contact structure (not shown). A spring 190 is disposed between each spanner 208 and upper wall 214 of each housing 204. This compression spring exerts a biasing force against the spanner to urge it into contact with lower wall 116. The springs then permit movement of the spanners within the housings to maintain adequate contact between the contact pads carried by each spanner and stationary contact assemblies of the type described above with reference to FIGS. 7, 8, 9 and 10 during operation. As shown in FIGS. 17 and 18, projections 220 and 222 are provided on a lower face of upper wall 214, and on spanner 208, respectively, to aid in locating spring 190 therebetween, and for maintaining alignment of the spanner within the respective housing. Again, as in the case of the foregoing embodiment, springs 190 are thus shielded from arcs by the modular housing structure, and are easily installed without the need for additional tension members other than housing 204.

As illustrated in FIG. 16, the foregoing arrangement may be adapted to provide a plurality of spanners and associated contact pads for each phase section of the contactor. In particular, in the embodiment of FIG. 16, two spanners 208 are provided within risers for each power phase section. Each riser is, in turn, divided into housings 204 supporting each individual spanner. As described above, the spanners are associated with biasing springs 190, protected by housings 204, for urging the spanners toward a lower or biased position. Moreover, each spanner is associated with a pair of stationary contacts 50, for completing current-carrying paths between pairs of stationary contacts upon closure of the contactor.

As best illustrated in FIG. 17, in the assembled contactor, each spanner 208 is positioned above the stationary contact assemblies described with reference to FIGS. 7–10. Upon movement of the carrier assembly in a downward direction, contacts 210 are brought into contact with the stationary contacts, thereby completing the current-carrying path therethrough. Upon opening of the contactor, these contact pads separate from the stationary contacts, with arcs being drawn from the opening surfaces as described above.

CONTACTOR HOUSING

Figure 19:
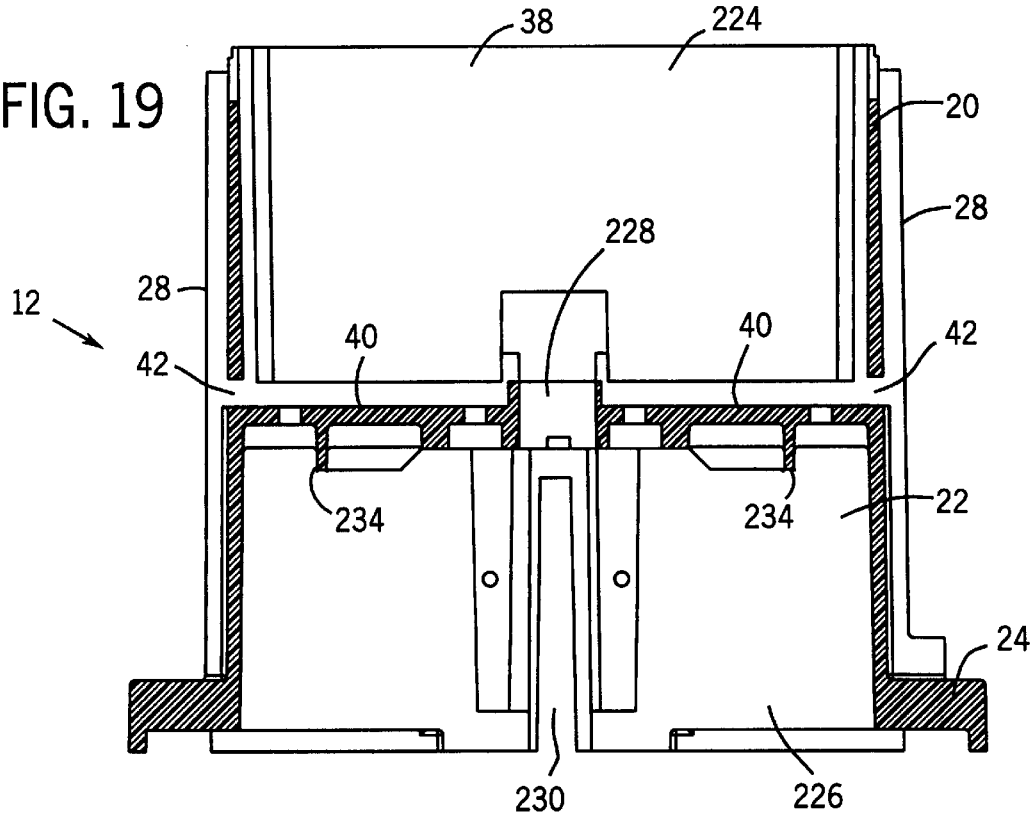
FIG. 19 is a sectional view of the housing of FIG. 2, along line 19—19, illustrating internal partitions dividing a contact portion of the housing from an operator portion.
Figure 20:
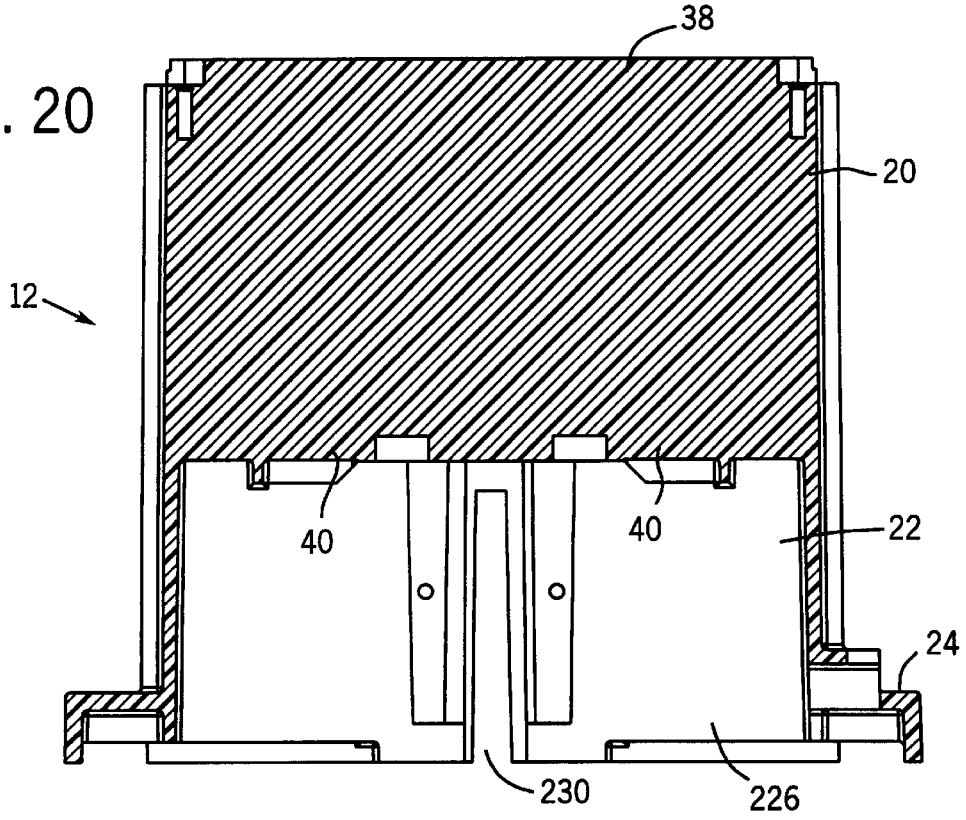
FIG. 20 is a sectional view of the housing of FIG. 2, along line 20—20, illustrating an internal partition between power phase sections of the housing.

As mentioned above, housing 12 is configured with integral partitions to divide the areas occupied by the operator assembly and contact Assemblies from one another. Presently configurations of housing 12 are illustrated in greater detail in FIGS. 19–23. As shown in FIGS. 19 and 20, housing 12 includes end panels 20 and side walls 22 extending therebetween. Housing 12 is preferably a unitary structure molded of a thermoplastic material with good mechanical strength, high deflection temperature and flame retardancy, such as a glass filled thermoplastic polyphthalamide (PPA) commercially available from Amoco under the designation Amodel. Due to the arc management, thermal management and power reduction afforded by the stationary and movable contact structures described above, and by the operator assembly and control technique described below, it has been found that a unitary thermoplastic housing is capable of withstanding temperatures generated during operation of the contactor. Thus, in contrast to heretofore known contactor structures, housing 12 may include contiguous side walls and partitions which effectively isolate regions of the internal volume from one another, thereby reducing the potential for discharges and transfer of plasma between the operational components of the contactor, particularly between power phases. In particular, it has been found that the unitary housing configuration made of a thermoplastic as described herein is now viable in larger contactor sizes and ratings.

As best illustrated in FIGS. 19, 20 and 21, these partitions include both vertically oriented phase partitions 38 which extend in an upper part of the housing between end panels 20. Contact partitions 40 divide the housing into upper and lower volumes. The partitions effectively define a series of upper contact compartments 224 and a lower operator compartment 226. The contact compartments 224 are separated from one another by integral phase partitions 38, and the contact compartments are separated from the operator compartment by contact partitions 40. In the illustrated embodiment, contact partitions 40 form a floor-like structure which is integral with end panels 20 (see, e.g., FIGS. 19 and 20), side walls 22 (see, e.g., FIG. 21), and with the phase partitions 38. Likewise, phase partitions 38 are integral with end panels 20 (see, e.g., FIG. 20).

Housing 12 includes features for accommodating the carrier assembly described above. In particular, a series of carrier slots 228 (see FIGS. 19 and 22) are formed through contact partitions 40 to permit the carrier piece to extend from the operator compartment 226 to the contact compartments 224. As noted above, the carrier piece supports a movable armature on its lower side, and movable contact assemblies on its upper extremities. A guide slot 230 is formed in each side wall 22 for guiding the carrier assembly in its translational movement. As best illustrated in FIG. 14, the carrier assembly includes guide extensions 232 which engage slots 230 to maintain alignment of the carrier assembly throughout its movement. As shown in FIGS. 19 and 22, housing 12 includes a series of lower ribs 34 integrally formed with contact partitions 40. Ribs 234 serve to define an internal air cushioning volume in which air within the operator compartment is compressed during rapid movement of the carrier assembly. Thus, ribs 234 serve to cushion the carrier assembly as it approaches the end of its movement upwardly upon release of the operator and upward movement of the carrier.

Figure 23:
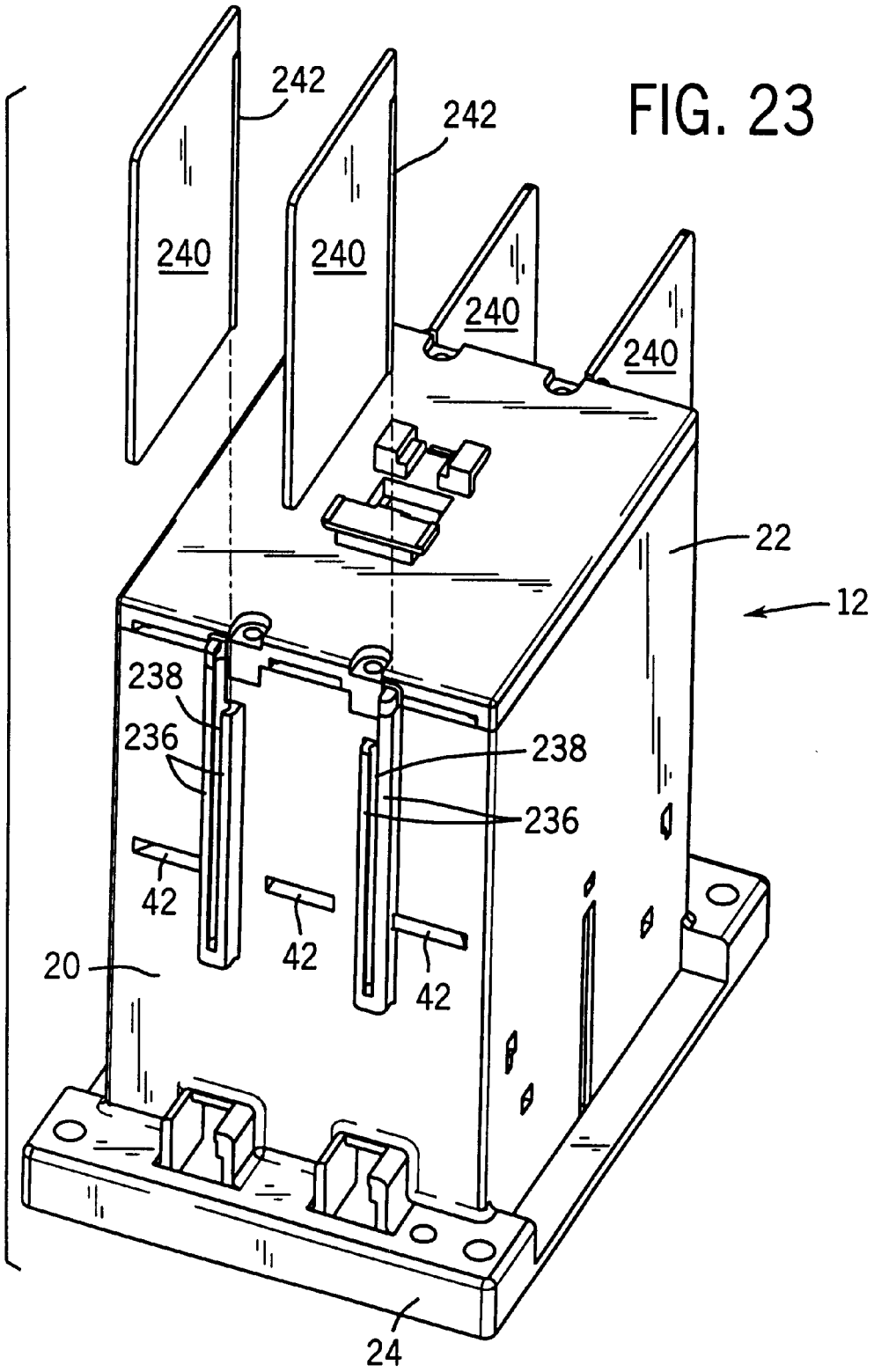
FIG. 23 is a perspective view of an alternative housing configuration, including partitions for separating power phase sections from one another on an external wall of the housing.

FIG. 23 illustrates an alternative configuration for housing 12, including the foregoing features, as well as external dividers for further isolating the phase sections of the contactor from one another. As shown in FIG. 23, housing 12 may be provided with a plurality of side ribs 236 extending in pairs vertically along end panels 20, between terminal slots 42. Each pair of side ribs 236 defines a vertical space 238 therebetween. Dividing panels 240 may be installed in the ribs, and each includes a longitudinal bead 242 which is slideable within a space 238 defined by the ribs. Thus, dividing panels 240 may be installed between terminals extending from slots 242 to further separate the phase sections from one another.

During operation, the foregoing housing structure contains plasmas, gases and material vapors within the individual compartments defined therein. For example, within each phase section, plasma created during opening of the contactor is restricted from flowing into neighboring phase sections by contiguous partitions 38 and 40. The plasma is similarly restrained from flowing outwardly from the housing by partition 40, which is contiguous with panels 20 and side walls 22. Resistance to hot plasmas and arcs is aided during operation by splitter plate supports 102 (see, e.g., FIG. 2), which at least partially shield portions of the housing in the vicinity of the splitter plates.

OPERATOR ASSEMBLY

Figure 24:
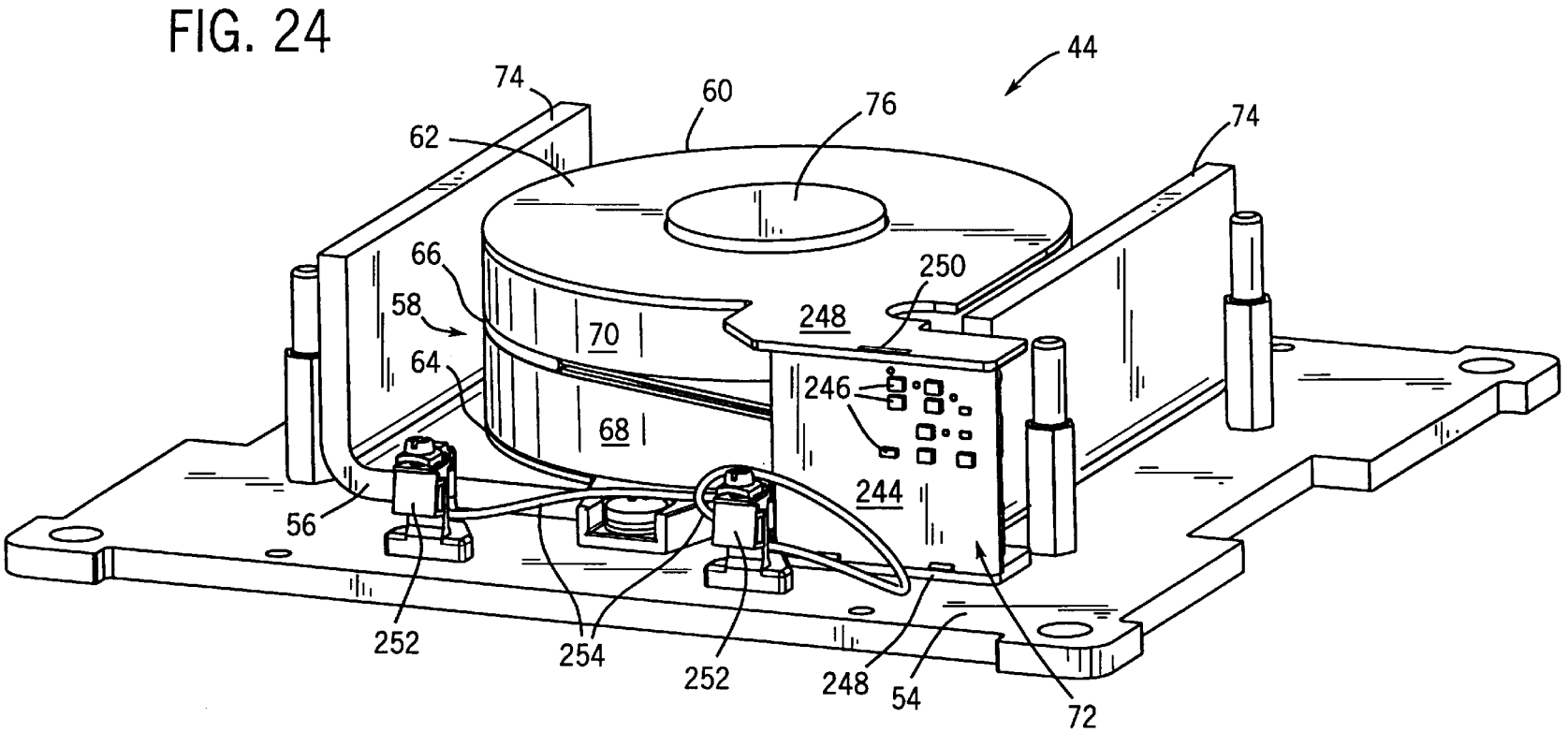
FIG. 24 is a perspective view of a magnetic operator assembly of the type shown in FIGS. 2 and 3, illustrating in greater detail the components of the operator.
Figure 25:
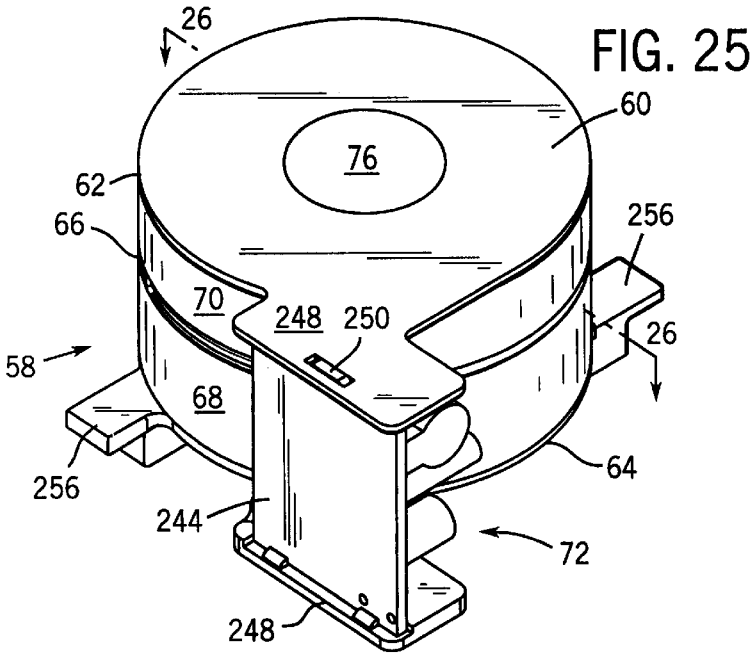
FIG. 25 is a sectional view of the coil assembly of the operator of FIG. 24, illustrating a structure for routing coil wires of the operator to a control circuit board.
Figure 26:
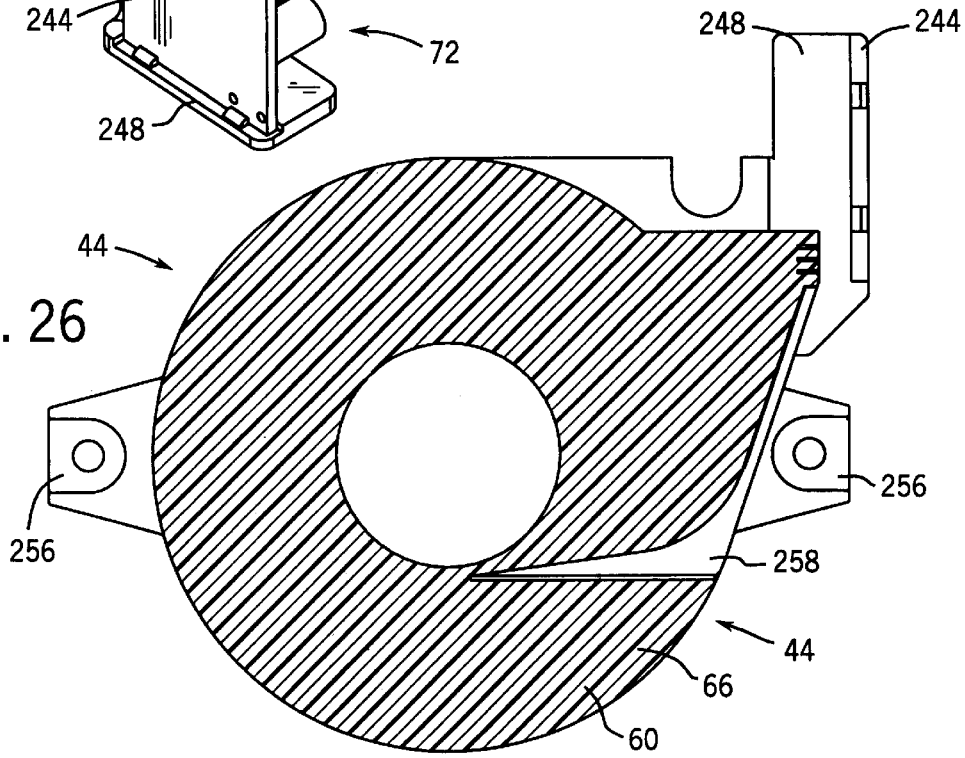
FIG. 26 is a perspective view of a coil assembly and circuit board support for use in the operator of FIG. 24.

FIGS. 24, 25 and 26 illustrate presently preferred configurations for the operator assembly 44 discussed above. As mentioned above, operator assembly 44 includes a base plate 54 which serves as a support for the components of the assembly. A unitary yoke 56 is mounted to base plate 54 and a coil assembly 58 is supported thereon. Yoke 56 may be formed of a bent ferromagnetic plate, such as steel, to define side flanges 74 extending around coil assembly 58. A core 76 is provided integral with yoke 56 to further enhance the magnetic field generated during energization of the coil assembly.

Coil assembly 58 includes a pair of coils which may be powered by either alternating current or direct current power. As described below, by virtue of the preferred control circuitry, the coils take the general configuration of DC coils independent of the type of power applied to the operator assembly. Thus, in the illustrated embodiment, a holding coil 68 is provided in a lower position on bobbin 60, while a pick up coil 70 is provided in an upper position. Coils 68 and 70 are wound in the same direction and are co-axial with one another, such that both coils may be energized to provide a maximum pickup force, and subsequently pickup coil 70 may be de-energized to reduce the power consumption of the contactor. As described below, in a preferred embodiment, pickup 70 is de-energized following a prescribed time period which is a function of a parameter of the control signal applied to the operator assembly, such as voltage.

In the illustrated embodiment, bobbin 60 also serves to support a control circuit board 244 on which control circuit 72 is mounted. Surface components 246 defining control circuit 72 are supported on board 244. Support extensions 248 are formed integrally with upper and lower flanges 62 and 64 of bobbin 60, to hold board 244 in a desired position adjacent to the coils. In the illustrated embodiment, tabs 250 formed on board 244 are lodged within apertures provided in support extensions 248 to maintain the board in the desired position. As will be appreciated by those skilled in the art, leads extending from coils 68 and 70 are routed to board 244, and interconnected with control circuitry as described more fully below. Operator terminals 252 are supported on base plate 54, and are electrically coupled to board 44 via terminal leads 254. In an alternative configuration illustrated in FIG. 25, hold down tabs 256 may be provided at diametrically opposed locations on either side of coil assembly 58.

In both the embodiment of FIG. 24 and that of FIG. 25, bobbin 60 is preferably configured to facilitate the wiring of coils 68 and 70 and a connection of the coils to the control circuitry. In particular, FIG. 26 shows a sectional view of bobbin 60 through intermediate flange 66. As shown in FIG. 26, a lead groove 258 is formed in intermediate flange 66 to permit an inner end of one of the coils to be routed directly to board 244. Thus, in manufacturing of the coil assembly, both coils may be wound about bobbin 60, and leads routed directly outwardly from the bobbin at upper, lower and intermediate locations for connection to board 244. Subsequently, board 244 may be installed in support extensions 248 and interconnected with terminals 252 or 254, according to the particular embodiment desired. The provision of routing groove 258 also facilitates control of the polarity of the coils, permitting the incoming and outgoing leads of each coil to be easily identified by their relative position exiting from the bobbin.

It should be noted that alternative configurations may be envisaged for disposing the pickup and holding coils of assembly 58. In the illustrated embodiment, these coils are disposed coaxially in separate annular grooves within bobbin 60, and are wound electrically in parallel with one another. Alternatively, one of the coils may be wound on top of the other, such as within a single annular groove of a modified bobbin. Also, in appropriate systems, the coils may be electrically coupled in series with one another during certain phases of their operation.

Figure 27:
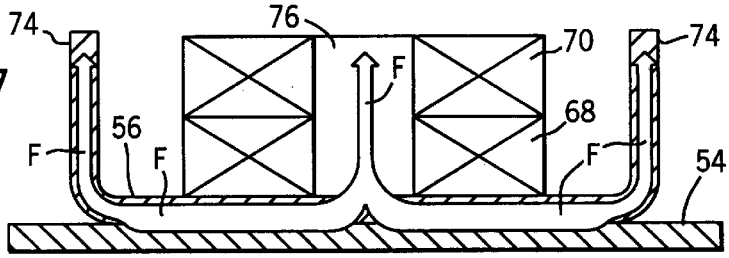
FIG. 27 is a diagrammatical view of the armature and base plate of the operator assembly shown in FIG. 24, illustrating flow of magnetic flux during energization of the operator coils.

As best illustrated in FIG. 27, the foregoing arrangement of yoke 56 and a ferromagnetic base plate 54 enhances the flow of flux within the operator during operation. In particular, when one or both of the coils of the operator are energized, lines of flux are channeled through the central core 76 of the armature, through the body of the armature, and through the side flanges 74. Base plate 54 aids in channeling the flux between these regions of the armature, as indicated by lines F in FIG. 27. By virtue of the combination of the armature and base plate, the primary body of the armature may be made of a constant thickness plate which is bent to form the side flanges illustrated, providing a simple and cost effective assembly.

CONTROL CIRCUIT

As mentioned above, control circuitry for commanding actuation of the contactor facilitates the use of either alternating or direct current power. Moreover, by virtue of the preferred configurations of the stationary and movable contact structures described above, it has been found that significantly lower power levels may be employed by the operator both during transient and steady-state operation. Power consumption is further reduced by the use of two separate coils, both of which are powered during initial actuation of the contactor, and only one of which is powered during steady-state operation. The pickup coil has a significantly higher MMF and power than the hold coil. A presently preferred embodiment for such control circuitry is illustrated in FIG. 28.

Figure 28:
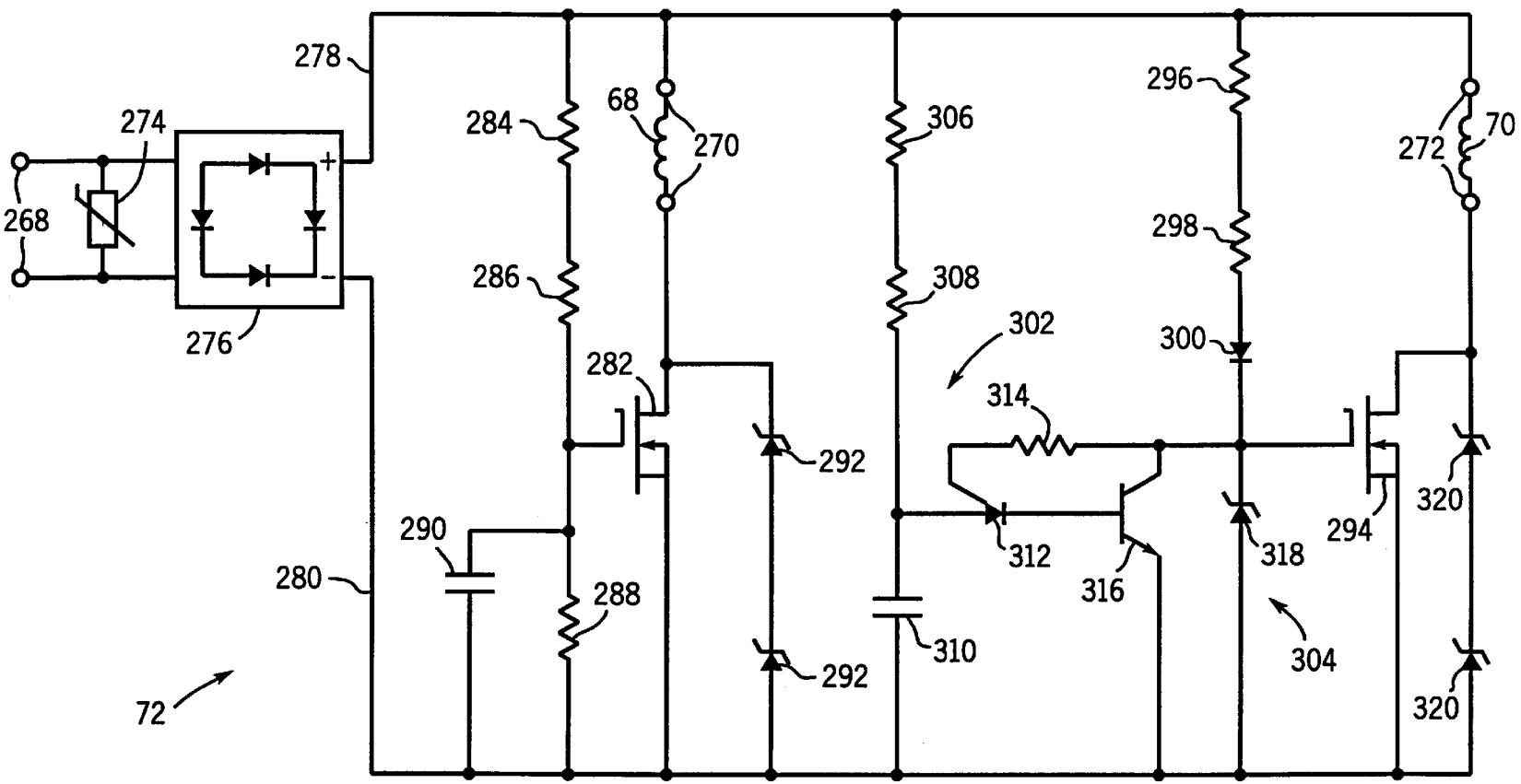
FIG. 28 is a diagram of an exemplary circuit for use in controlling the operator of FIG. 24, permitting the use of both alternating current and direct current power, and for allowing rapid and high efficiency operation of the coil assembly.

As shown in FIG. 28, control circuit 72 includes a pair of input terminals 268 for receiving either AC or DC power. Holding coil terminals 270, and pickup coil terminals 272 are provided for coupling to holding coil 68 and pickup coil 70, respectively. A metal oxide varister (MOV) 274 or other transient circuit protector extends between terminals 268 to limit incoming power peaks in a manner generally known in the art.

Downstream of MOV 274 circuit 72 includes a rectifier bridge 276 for converting AC power to DC power when the device is to be actuated by such AC control signals. As mentioned above, although DC power may be applied to terminals 268, when AC power is applied, such AC power is converted to a rectified DC waveform by bridge circuit 276. Bridge rectifier 276 applies the DC waveform to a DC bus as defined by lines 278 and 280 in FIG. 28. When DC power is to be used for actuating the contactor, bridge circuit 276 transmits the DC power directly to high and low sides 278 and 280 of the DC bus while maintaining proper polarity. As described in greater below, power applied to the high and low sides of the DC bus is selectively channeled through the coils coupled to terminals 270 and 272 to energize and de-energize the operator assembly. Moreover, the preferred configuration of circuit 72 permits release of pickup coil 70 following an initial actuation phase, thereby reducing the energy consumption of the operator assembly. The circuitry also facilitates rapid release of the holding coil, and interruption of any induced current that would be allowed to recirculate through the coil by the presence of rectifier circuit 276.

As illustrated in FIG. 28, control circuit 72 includes a field effect transistor (FET) 282 for controlling energization of holding coil 68. Additional components, described in greater detail below, provide for latching of FET 282 upon application of voltage to the DC bus. The circuitry also provides for rapidly interrupting a current-carrying path through the FET, and hence through coil 68 upon removal of the energizing power. By virtue of the removal ofthis current-carrying path, induced current through the coil is interrupted, permitting rapid opening of the contactor. Circuit 72 also includes an FET 294 for selectively energizing pickup coil 70. Clamping circuitry is provided for maintaining FET 294 closed and a timing circuit is included for opening FET 294 after an initial energization phase as described below.

FET 282 is disposed in series with coil 68 between high and low sides 278 and 280 of the DC bus. In parallel with these components, a pair of 100 KΩ resistors 284 and 286 are provided, as well as a 21.5 KΩ at resistor 288. In parallel with resistor 288, a 0.22 microF capacitor 290 is coupled to low side 280 of the DC bus. The gate of FET 282 is coupled to a node point between resistors 286 and resistor 288. A pair of Zener diodes 292 are provided in parallel with FET 282, extending from a node point between the drain of the FET and low side 280 of the DC bus. The operation of the foregoing components is described in greater detail below.

Operative circuitry for controlling the energization of pickup coil 70 includes a pair of 43.2 KΩ resistors 296 and 298 coupled in series with a diode 300. Diode 300 is, in turn, coupled to a node point to which the drain of FET 294 is coupled. A timing circuit, represented generally by the reference numeral 302, provides for de-energizing coil 70 after an initial engagement period. Also, a clamping circuit 304 is provided for facilitating such initial energization of the pickup coil. In the illustrated embodiment, timing circuit 302 includes a pair of 43.2 KΩ resistors 306 and 308 coupled in a series with a 10 microF capacitor 310 between high and low sides 278 and 280 of the DC bus. A programmable uni-junction transistor (UT) 312 is coupled to a node point between resistor 308 and capacitor 310. PUT 312 is also coupled to the gate node point of FET 294 through a 511 KΩ resistor 314. Output from PUT 312 is coupled to the base of an n-p-n transistor 316, the collector of which is coupled to the node point of the gate of FET 294, and the emitter of which is coupled to low side 280 of the DC bus. In parallel with transistor 316, a Zener diode 318 is provided. Finally, in parallel with FET 294, a pair of Zener diodes 320 are coupled between coil 70 and the low side of the DC bus.

The foregoing control circuitry operates to provide initial energization of both the pickup and holding coils, dropping out the pickup coil after an initial engagement phase, and interrupting an induced current path through the holding coil upon de-energization of the circuit. In particular, upon application of power to terminals 268, a potential difference is established between DC bus sides 278 and 280. This potential difference causes FET 282 to be closed, and to remain closed so long as the voltage is applied to the bus. At the same time, PUT 312 serves to compare a voltage established at capacitor 310 to a reference voltage from Zener diode 318. During an initial phase of operation, the output from PUT 310 will maintain transistor 316 in a non-conducting state, thereby closing FET 294 and energizing pickup coil 70. However, as the voltages input to PUT 312 approach one another, as determined by the time constant established by resistors 306 and 308 in combination with capacitor 310, transistor 316 will be switched to a conducting state, thereby causing FET 294 to turn off, dropping out pickup coil 70. Voltage spikes from the pickup coil are suppressed by Zener diodes 320. As will be appreciated by those skilled in the art, the duration of energization of pickup coil 70 will depend upon the selection of resistors 306 and 308, and of capacitor 310, as well as the voltage applied to the circuit. Thus, pickup coil 70 is energized for a duration proportional to the actuation voltage applied to the control circuit.

Following the initial actuation phase of operation, holding coil 68 alone suffices to maintain the contactor in its actuated position. In particular, during the initial phase of operation, electromagnetic fields generated by both pickup coil 70 and holding coil 68 are enhanced and directed by yoke 56 to attract movable armature 90 supported on the carrier assembly (see, e.g., FIGS. 2, 3, 14 and 24). This initial magnetic field causes the carrier assembly to be drawn towards the electromagnet, closing the current-carrying paths established between the movable and stationary contact assemblies described above. The initial energization phase, after which pickup coil 70 is de-energized by control circuit 72, preferably lasts a sufficient duration to permit full movement and engagement of the carrier assembly and the movable contacts. Thereafter, to reduce the energy consumption of the contactor, only holding coil 68 remains energized.

As mentioned above, so long as voltage is maintained on the DC bus of the control circuit, holding coil 68 will remain energized. Once actuation voltage is removed from the circuit, the drain of FET 282 assumes a logical low voltage, opening the current-carrying path through the FET. Residual energy stored within the holding coil is dissipated through Zener diodes 292. As will be appreciated by those skilled in the art, the removal of the current-carrying path established by FET 282 permits for rapid opening of the contactor under the influence of springs 78, 188 and 190 (see, e.g., FIGS. 2, 3 and 14). Thus, when power is removed, magnetic lines of flux established by coil 68 begin to collapse and springs 78 begin to displace the carrier assembly within the contactor. Opening of FET 282 effectively removes the current-carrying path that would otherwise be established through bridge rectifier 276. Such current-carrying paths can cause an increase in the coil current under the influence of induced currents during displacement of the movable armature, retarding the opening of the device. By removal of this conductive path, the electromagnet is fully released, and such induced currents are minimized, enhancing the transient response of the device.

As will be appreciated by those skilled in the art, various alternative arrangements may be envisaged for the foregoing structures of control circuit 72. In particular, while analog circuitry is provided for de-energizing pickup coil 70 after the initial engagement phase of operation, other circuit configurations may be used to perform this function, including digital circuitry. Similarly, while in the present embodiment the period for the initial energization of pickup coil 70 is determined by an RC time constant and the voltage applied to the components defining this time constant, the time period for energization of the pickup coil could be based upon other operational parameters of the control circuitry or control signal. Moreover, while the circuitry described in presently preferred for interruption of a current-carrying path through rectifier 276, various alternative configurations may be envisaged for this function. Furthermore, the particular component values described above have been found suitable for a 120 volt contactor. Depending upon the device rating, the other components may be selected accordingly.

As will be appreciated by those skilled in the art, considerable advantages flow from the use of the dual coil operator assembly described above in connection with control circuit 72. In particular, the use of DC coils offers the significant advantages of such coil designs, eliminating vibration or buzzing typical in AC coils, the need for shading coils, and other disadvantages of conventional AC coils. Also, the use of such coils in combination with a rectifier circuit facilitates the use of a single assembly for both AC and DC powered applications creating a more universally applicable contactor. Furthermore, by providing both holding and pickup coils, and releasing the pickup coil after initial movement of the carrier assembly, energy consumption, and thereby thermal energy dissipation, is significantly reduced during steady-state operation of the contactor. Such reduction in thermal energy permits the use of such materials as thermoplastics for the construction of the contactor housing. Moreover, by interrupting a current path between holding coil 68 and rectifier 276 upon release of the contactor, opening times for the contactor are significantly reduced.

While the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention as defined by the following appended claims. For example, those skilled in the art will readily recognize that the foregoing innovations may be incorporated into switching devices of various types and configurations. Similarly, certain of the present teachings may be used in single-phase devices as well as multi-phase devices, and in devices having different numbers of poles, including, for example, 4 and 5 pole contactors.

What is claimed is:

1. A modular movable contact assembly for an electrical contactor providing an interruptable current path, the contact assembly comprising:

an enclosure configured to be secured to a carrier for displacement within the contactor, the enclosure being displaceable relative to the stationary contact pads;

a movable contact element including an electrically conductive body extending through the enclosure, the electrically conductive body first and second movable contact pads disposed at first and second ends of the contact element, the first and second ends extending from the enclosure; and at least one biasing member disposed within the enclosure for urging the movable contact element toward a biased position in which the first and second movable contact pads are biased toward the stationary contact pads;

the contact assembly, including the enclosure, the movable contact element and the at least one biasing member, being preassembled as a modular unit configured to be removably secured to the carrier.

2. The contact assembly of claim 1, wherein the movable contact element includes a panel extending in a direction of movement of the contact element, and wherein the enclosure includes a guide slot for contacting the panel and guiding movement of the contact element.

3. The contact assembly of claim 1, wherein the at least one biasing member exerts a biasing force against a side of the movable contact element opposite from a side thereof on which the contact pads are disposed.

4. The contact assembly of claim 1, further comprising at least one second movable contact element having a conductive body extending through the enclosure and third and fourth contact pads disposed at ends thereof outside the enclosure.

5. The contact assembly of claim 1, further comprising at least one fastener extending through the enclosure for securing the enclosure to the carrier.

6. The contact assembly of claim 1, wherein the movable contact element includes first and second arc guides extending from the first and seconds ends thereof, respectively.

7. A movable contact assembly for an electrical contactor providing an interruptable current-carrying path, the assembly comprising:

a modular housing configured to be removably secured to a carrier for displacing the modular housing within the contactor relative to the stationary contact pads;

a movable conductive element having a central portion disposed within the housing, and first and second movable contact pads disposed on at first and second ends thereof outside the housing; and a compression member disposed intermediate the housing and the central portion of the conductive element, the compression member exerting a biasing force against the housing and the conductive element to urge the conductive element toward a contact position;

the contact assembly, including the enclosure, the movable contact element and the at least one biasing member, being preassembled as a modular unit configured to be removably secured to a carrier of the contactor.

8. The contact assembly of claim 7, wherein the housing includes side walls at least partially surrounding the central portion of the movable element and the compression member on sides of the housing through which the movable element extends for shielding the central portion and the compression member from arcs and debris generated during operation.

9. The contact assembly of claim 8, wherein the side walls include at least one guide slot for guiding displacement of the movable conductive element within the housing.

10. The contact assembly of claim 7, wherein the compression member exerts the biasing force against a side of the movable conductive element opposite a side thereof on which the contact pads are disposed.

11. The contact assembly of claim 7, comprising a plurality of compression members exerting force on the housing and on the movable conductive element to urge the conductive element toward the contact position.

12. The contact assembly of claim 7, comprising a plurality of conductive elements each having central portions disposed within the housing and contact pads disposed outside the housing, and a plurality of compression members exerting forces against respective conductive elements to urge the conductive elements toward respective contact positions.

13. The contact assembly of claim 7, wherein the housing includes an interface surface configured to contact a carrier member within the contactor for securement of the movable contact assembly to the carrier member.

14. A contactor for completing and interrupting electric current carrying paths between a source of electrical power and a load, the contactor comprising:

a housing;

an operator disposed in the housing;

stationary contacts disposed in the housing;

a carrier movable under the influence of the operator; and a movable contact assembly coupled to the carrier for movement relative to the stationary contacts, the movable contact assembly including a modular housing removably supported on the carrier, a conductive element disposed in the housing, the conductive element having contact pads disposed thereon for selectively contacting the stationary contacts, and a biasing member exerting a biasing force on the housing and on the conductive element to urge the conductive element towards a contact position in which the contact pads contact the stationary contacts, the contact assembly, including the enclosure, the movable contact element and the at least one biasing member, being a modular unit configured to be removably secured to a carrier of the contactor.

15. The contactor of claim 14, wherein the modular housing of the movable contact assembly includes side walls at least partially surrounding the biasing member on sides of the housing through which the movable element extends for shielding the central portion and the compression member from arcs and debris generated during operation.

16. The contactor of claim 14, wherein the biasing member includes a compression spring disposed between the housing and the conductive element to exert the biasing force on a side of the conductive element opposed to a side thereof on which the contact pads are disposed.

17. The contactor of claim 14, comprising a plurality of modular movable contact assemblies and a corresponding plurality of stationary contact sets, each modular movable contact assembly being supported on the carrier and movable with the carrier to establish and interrupt a current carrying path through the contactor.

18. The contactor of claim 14, wherein the housing includes an opening over the movable contact assembly and a cover over the opening, and wherein the movable contact assembly is removable from the carrier through the opening upon displacement of the cover.

19. The contactor of claim 18, wherein the movable contact assembly is secured to the carrier via at least one fastener and is removable from the carrier by loosening of the fastener.

* * * * *